US008550835B2

(12) United States Patent
Montena

(10) Patent No.: US 8,550,835 B2
(45) **Date of Patent: *Oct. 8, 2013**

(54) CONNECTOR HAVING A NUT-BODY CONTINUITY ELEMENT AND METHOD OF USE THEREOF

(71) Applicant: PPC Broadband, Inc., East Syracuse, NY (US)

(72) Inventor: Noah Montena, Syracuse, NY (US)

(73) Assignee: PPC Broadband, Inc., East Syracuse, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/860,964

(22) Filed: Apr. 11, 2013

(65) Prior Publication Data

US 2013/0224995 A1 Aug. 29, 2013

Related U.S. Application Data

(63) Continuation of application No. 13/712,498, filed on Dec. 12, 2012, which is a continuation of application No. 13/016,114, filed on Jan. 28, 2011, now Pat. No. 8,337,229.

(60) Provisional application No. 61/412,611, filed on Nov. 11, 2010.

(51) Int. Cl.
*H01R 13/62* (2006.01)

(52) U.S. Cl.
USPC ..... 439/322

(58) Field of Classification Search
USPC ..... 439/320–323, 578, 607.01, 607.03
See application file for complete search history.

(56) References Cited

U.S. PATENT DOCUMENTS

| | | | |
|---|---|---|---|
| 331,169 | A | 11/1885 | Thomas |
| 1,371,742 | A | 3/1921 | Dringman |
| 1,667,485 | A | 4/1928 | MacDonald |
| 1,766,869 | A | 6/1930 | Austin |
| 1,801,999 | A | 4/1931 | Bowman |
| 1,885,761 | A | 11/1932 | Peirce, Jr. |
| 2,102,495 | A | 12/1937 | England |

(Continued)

FOREIGN PATENT DOCUMENTS

| | | | |
|---|---|---|---|
| CA | 2096710 | A1 | 11/1994 |
| CN | 201149936 | Y | 11/2008 |

(Continued)

OTHER PUBLICATIONS

Digicon AVL Connector. ARRIS Group Inc. [online]. 3 pages. [retrieved on Apr. 22, 2010]. Retrieved from the Internet:<URL: http://www.arrisi.com/special/digiconAVL.asp>.

(Continued)

*Primary Examiner* — Renee Luebke
*Assistant Examiner* — Larisa Tsukerman
(74) *Attorney, Agent, or Firm* — Schmeiser, Olsen & Watts LLP

(57) ABSTRACT

A connector having a nut-body continuity element is provided, wherein the nut-body continuity element electrically couples a nut and a connector body, thereby establishing electrical continuity between the nut and the connector body. Furthermore, the nut-body continuity element facilitates grounding through the connector, and renders an electromagnetic shield preventing ingress of unwanted environmental noise.

21 Claims, 13 Drawing Sheets

(56) References Cited

U.S. PATENT DOCUMENTS

| | | | |
|---|---|---|---|
| 2,258,737 | A | 10/1941 | Browne |
| 2,325,549 | A | 7/1943 | Ryzowitz |
| 2,480,963 | A | 9/1949 | Quinn |
| 2,544,654 | A | 3/1951 | Brown |
| 2,549,647 | A | 4/1951 | Turenne |
| 2,694,187 | A | 11/1954 | Nash |
| 2,754,487 | A | 7/1956 | Carr et al. |
| 2,755,331 | A | 7/1956 | Melcher |
| 2,757,351 | A | 7/1956 | Klostermann |
| 2,762,025 | A | 9/1956 | Melcher |
| 2,805,399 | A | 9/1957 | Leeper |
| 2,870,420 | A | 1/1959 | Malek |
| 3,001,169 | A | 9/1961 | Blonder |
| 3,015,794 | A | 1/1962 | Kishbaugh |
| 3,091,748 | A | 5/1963 | Takes et al. |
| 3,094,364 | A | 6/1963 | Lingg |
| 3,184,706 | A | 5/1965 | Atkins |
| 3,194,292 | A | 7/1965 | Borowsky |
| 3,196,382 | A | 7/1965 | Morello, Jr. |
| 3,245,027 | A | 4/1966 | Ziegler, Jr. |
| 3,275,913 | A | 9/1966 | Blanchard et al. |
| 3,278,890 | A | 10/1966 | Cooney |
| 3,281,757 | A | 10/1966 | Bonhomme |
| 3,292,136 | A | 12/1966 | Somerset |
| 3,320,575 | A | 5/1967 | Brown et al. |
| 3,321,732 | A | 5/1967 | Forney, Jr. |
| 3,336,563 | A | 8/1967 | Hyslop |
| 3,348,186 | A | 10/1967 | Rosen |
| 3,350,677 | A | 10/1967 | Daum |
| 3,355,698 | A | 11/1967 | Keller |
| 3,373,243 | A | 3/1968 | Janowiak et al. |
| 3,390,374 | A | 6/1968 | Forney, Jr. |
| 3,406,373 | A | 10/1968 | Forney, Jr. |
| 3,430,184 | A | 2/1969 | Acord |
| 3,448,430 | A | 6/1969 | Kelly |
| 3,453,376 | A | 7/1969 | Ziegler, Jr. et al. |
| 3,465,281 | A | 9/1969 | Florer |
| 3,475,545 | A | 10/1969 | Stark et al. |
| 3,494,400 | A | 2/1970 | McCoy et al. |
| 3,498,647 | A | 3/1970 | Schroder |
| 3,501,737 | A | 3/1970 | Harris et al. |
| 3,517,373 | A | 6/1970 | Jamon |
| 3,526,871 | A | 9/1970 | Hobart |
| 3,533,051 | A | 10/1970 | Ziegler, Jr. |
| 3,537,065 | A | 10/1970 | Winston |
| 3,544,705 | A | 12/1970 | Winston |
| 3,551,882 | A | 12/1970 | O'Keefe |
| 3,564,487 | A | 2/1971 | Upstone et al. |
| 3,587,033 | A | 6/1971 | Brorein et al. |
| 3,601,776 | A | 8/1971 | Curl |
| 3,629,792 | A | 12/1971 | Dorrell |
| 3,633,150 | A | 1/1972 | Swartz |
| 3,646,502 | A | 2/1972 | Hutter et al. |
| 3,663,926 | A | 5/1972 | Brandt |
| 3,665,371 | A | 5/1972 | Cripps |
| 3,668,612 | A | 6/1972 | Nepovim |
| 3,669,472 | A | 6/1972 | Nadsady |
| 3,671,922 | A | 6/1972 | Zerlin et al. |
| 3,678,444 | A | 7/1972 | Stevens et al. |
| 3,678,445 | A | 7/1972 | Brancaleone |
| 3,680,034 | A | 7/1972 | Chow et al. |
| 3,681,739 | A | 8/1972 | Kornick |
| 3,683,320 | A | 8/1972 | Woods et al. |
| 3,686,623 | A | 8/1972 | Nijman |
| 3,694,792 | A | 9/1972 | Wallo |
| 3,706,958 | A | 12/1972 | Blanchenot |
| 3,710,005 | A | 1/1973 | French |
| 3,739,076 | A | 6/1973 | Schwartz |
| 3,744,007 | A | 7/1973 | Horak |
| 3,744,011 | A | 7/1973 | Blanchenot |
| 3,778,535 | A | 12/1973 | Forney, Jr. |
| 3,781,762 | A | 12/1973 | Quackenbush |
| 3,781,898 | A | 12/1973 | Holloway |
| 3,793,610 | A | 2/1974 | Brishka |
| 3,798,589 | A | 3/1974 | Deardurff |
| 3,808,580 | A | 4/1974 | Johnson |
| 3,810,076 | A | 5/1974 | Hutter |
| 3,835,443 | A | 9/1974 | Arnold et al. |
| 3,836,700 | A | 9/1974 | Niemeyer |
| 3,845,453 | A | 10/1974 | Hemmer |
| 3,846,738 | A | 11/1974 | Nepovim |
| 3,854,003 | A | 12/1974 | Duret |
| 3,858,156 | A | 12/1974 | Zarro |
| 3,879,102 | A | 4/1975 | Horak |
| 3,886,301 | A | 5/1975 | Cronin et al. |
| 3,907,399 | A | 9/1975 | Spinner |
| 3,910,673 | A | 10/1975 | Stokes |
| 3,915,539 | A | 10/1975 | Collins |
| 3,936,132 | A | 2/1976 | Hutter |
| 3,953,097 | A | 4/1976 | Graham |
| 3,963,320 | A | 6/1976 | Spinner |
| 3,963,321 | A | 6/1976 | Burger et al. |
| 3,970,355 | A | 7/1976 | Pitschi |
| 3,972,013 | A | 7/1976 | Shapiro |
| 3,976,352 | A | 8/1976 | Spinner |
| 3,980,805 | A | 9/1976 | Lipari |
| 3,985,418 | A | 10/1976 | Spinner |
| 4,017,139 | A | 4/1977 | Nelson |
| 4,022,966 | A | 5/1977 | Gajajiva |
| 4,030,798 | A | 6/1977 | Paoli |
| 4,046,451 | A | 9/1977 | Juds et al. |
| 4,053,200 | A | 10/1977 | Pugner |
| 4,059,330 | A | 11/1977 | Shirey |
| 4,079,343 | A | 3/1978 | Nijman |
| 4,082,404 | A | 4/1978 | Flatt |
| 4,090,028 | A | 5/1978 | Vontobel |
| 4,093,335 | A | 6/1978 | Schwartz et al. |
| 4,106,839 | A | 8/1978 | Cooper |
| 4,125,308 | A | 11/1978 | Schilling |
| 4,126,372 | A | 11/1978 | Hashimoto et al. |
| 4,131,332 | A | 12/1978 | Hogendobler et al. |
| 4,150,250 | A | 4/1979 | Lundeberg |
| 4,153,320 | A | 5/1979 | Townshend |
| 4,156,554 | A | 5/1979 | Aujla |
| 4,165,911 | A | 8/1979 | Laudig |
| 4,168,921 | A | 9/1979 | Blanchard |
| 4,173,385 | A | 11/1979 | Fenn et al. |
| 4,174,875 | A | 11/1979 | Wilson et al. |
| 4,187,481 | A | 2/1980 | Boutros |
| 4,225,162 | A | 9/1980 | Dola |
| 4,227,765 | A | 10/1980 | Neumann et al. |
| 4,229,714 | A | 10/1980 | Yu |
| 4,250,348 | A | 2/1981 | Kitagawa |
| 4,280,749 | A | 7/1981 | Hemmer |
| 4,285,564 | A | 8/1981 | Spinner |
| 4,290,663 | A | 9/1981 | Fowler et al. |
| 4,296,986 | A | 10/1981 | Herrmann et al. |
| 4,307,926 | A | 12/1981 | Smith |
| 4,322,121 | A | 3/1982 | Riches et al. |
| 4,326,769 | A | 4/1982 | Dorsey et al. |
| 4,339,166 | A | 7/1982 | Dayton |
| 4,346,958 | A | 8/1982 | Blanchard |
| 4,354,721 | A | 10/1982 | Luzzi |
| 4,358,174 | A | 11/1982 | Dreyer |
| 4,373,767 | A | 2/1983 | Cairns |
| 4,389,081 | A | 6/1983 | Gallusser et al. |
| 4,400,050 | A | 8/1983 | Hayward |
| 4,407,529 | A | 10/1983 | Holman |
| 4,408,821 | A | 10/1983 | Forney, Jr. |
| 4,408,822 | A | 10/1983 | Nikitas |
| 4,412,717 | A | 11/1983 | Monroe |
| 4,421,377 | A | 12/1983 | Spinner |
| 4,426,127 | A | 1/1984 | Kubota |
| 4,444,453 | A | 4/1984 | Kirby et al. |
| 4,452,503 | A | 6/1984 | Forney, Jr. |
| 4,456,323 | A | 6/1984 | Pitcher et al. |
| 4,462,653 | A | 7/1984 | Flederbach et al. |
| 4,464,000 | A | 8/1984 | Werth et al. |
| 4,464,001 | A | 8/1984 | Collins |
| 4,469,386 | A | 9/1984 | Ackerman |
| 4,470,657 | A | 9/1984 | Deacon |
| 4,484,792 | A | 11/1984 | Tengler et al. |
| 4,484,796 | A | 11/1984 | Sato et al. |
| 4,490,576 | A | 12/1984 | Bolante et al. |

4,506,943 A 3/1985 Drogo
4,515,427 A 5/1985 Smit
4,525,017 A 6/1985 Schildkraut et al.
4,531,790 A 7/1985 Selvin
4,531,805 A 7/1985 Werth
4,533,191 A 8/1985 Blackwood
4,540,231 A 9/1985 Forney, Jr.
RE31,995 E 10/1985 Ball
4,545,637 A 10/1985 Bosshard et al.
4,575,274 A 3/1986 Hayward
4,580,862 A 4/1986 Johnson
4,580,865 A 4/1986 Fryberger
4,583,811 A 4/1986 McMills
4,585,289 A 4/1986 Bocher
4,588,246 A 5/1986 Schildkraut et al.
4,593,964 A 6/1986 Forney, Jr. et al.
4,596,434 A 6/1986 Saba et al.
4,596,435 A 6/1986 Bickford
4,598,961 A 7/1986 Cohen
4,600,263 A 7/1986 DeChamp et al.
4,613,199 A 9/1986 McGeary
4,614,390 A 9/1986 Baker
4,616,900 A 10/1986 Cairns
4,632,487 A 12/1986 Wargula
4,634,213 A 1/1987 Larsson et al.
4,640,572 A 2/1987 Conlon
4,645,281 A 2/1987 Burger
4,650,228 A 3/1987 McMills et al.
4,655,159 A 4/1987 McMills
4,655,534 A 4/1987 Stursa
4,660,921 A 4/1987 Hauver
4,668,043 A 5/1987 Saba et al.
4,673,236 A 6/1987 Musolff et al.
4,674,818 A 6/1987 McMills et al.
4,676,577 A 6/1987 Szegda
4,682,832 A 7/1987 Punako et al.
4,684,201 A 8/1987 Hutter
4,688,876 A 8/1987 Morelli
4,688,878 A 8/1987 Cohen et al.
4,690,482 A 9/1987 Chamberland et al.
4,691,976 A 9/1987 Cowen
4,703,987 A 11/1987 Gallusser et al.
4,703,988 A 11/1987 Raux et al.
4,717,355 A 1/1988 Mattis
4,720,155 A 1/1988 Schildkraut et al.
4,734,050 A 3/1988 Negre et al.
4,734,666 A 3/1988 Ohya et al.
4,737,123 A 4/1988 Paler et al.
4,738,009 A 4/1988 Down et al.
4,738,628 A 4/1988 Rees
4,746,305 A 5/1988 Nomura
4,747,786 A 5/1988 Hayashi et al.
4,749,821 A 6/1988 Linton et al.
4,755,152 A 7/1988 Elliot et al.
4,757,297 A 7/1988 Frawley
4,759,729 A 7/1988 Kemppainen et al.
4,761,146 A 8/1988 Sohoel
4,772,222 A 9/1988 Laudig et al.
4,789,355 A 12/1988 Lee
4,797,120 A 1/1989 Ulery
4,806,116 A 2/1989 Ackerman
4,807,891 A 2/1989 Neher
4,808,128 A 2/1989 Werth
4,813,886 A 3/1989 Roos et al.
4,820,185 A 4/1989 Moulin
4,834,675 A 5/1989 Samchisen
4,835,342 A 5/1989 Guginsky
4,836,801 A 6/1989 Ramirez
4,838,813 A 6/1989 Pauza et al.
4,854,893 A 8/1989 Morris
4,857,014 A 8/1989 Alf et al.
4,867,706 A 9/1989 Tang
4,869,679 A 9/1989 Szegda
4,874,331 A 10/1989 Iverson
4,892,275 A 1/1990 Szegda
4,902,246 A 2/1990 Samchisen
4,906,207 A 3/1990 Banning et al.
4,915,651 A 4/1990 Bout
4,921,447 A 5/1990 Capp et al.
4,923,412 A 5/1990 Morris
4,925,403 A 5/1990 Zorzy
4,927,385 A 5/1990 Cheng
4,929,188 A 5/1990 Lionetto et al.
4,934,960 A 6/1990 Capp et al.
4,938,718 A 7/1990 Guendel
4,941,846 A 7/1990 Guimond et al.
4,952,174 A 8/1990 Sucht et al.
4,957,456 A 9/1990 Olson et al.
4,973,265 A 11/1990 Heeren
4,979,911 A 12/1990 Spencer
4,990,104 A 2/1991 Schieferly
4,990,105 A 2/1991 Karlovich
4,990,106 A 2/1991 Szegda
4,992,061 A 2/1991 Brush, Jr. et al.
5,002,503 A 3/1991 Campbell et al.
5,007,861 A 4/1991 Stirling
5,011,422 A 4/1991 Yeh
5,011,432 A 4/1991 Sucht et al.
5,021,010 A 6/1991 Wright
5,024,606 A 6/1991 Ming-Hwa
5,030,126 A 7/1991 Hanlon
5,037,328 A 8/1991 Karlovich
5,046,964 A 9/1991 Welsh et al.
5,052,947 A 10/1991 Brodie et al.
5,055,060 A 10/1991 Down et al.
5,059,747 A 10/1991 Bawa et al.
5,062,804 A 11/1991 Jamet et al.
5,066,248 A 11/1991 Gaver, Jr. et al.
5,073,129 A 12/1991 Szegda
5,080,600 A 1/1992 Baker et al.
5,083,943 A 1/1992 Tarrant
5,120,260 A 6/1992 Jackson
5,127,853 A 7/1992 McMills et al.
5,131,862 A 7/1992 Gershfeld
5,137,470 A 8/1992 Doles
5,137,471 A 8/1992 Verespej et al.
5,141,448 A 8/1992 Mattingly et al.
5,141,451 A 8/1992 Down
5,149,274 A 9/1992 Gallusser et al.
5,154,636 A 10/1992 Vaccaro et al.
5,161,993 A 11/1992 Leibfried, Jr.
5,166,477 A 11/1992 Perin, Jr. et al.
5,169,323 A 12/1992 Kawai et al.
5,181,161 A 1/1993 Hirose et al.
5,183,417 A 2/1993 Bools
5,186,501 A 2/1993 Mano
5,186,655 A 2/1993 Glenday et al.
5,195,905 A 3/1993 Pesci
5,195,906 A 3/1993 Szegda
5,205,547 A 4/1993 Mattingly
5,205,761 A 4/1993 Nilsson
5,207,602 A 5/1993 McMills et al.
5,215,477 A 6/1993 Weber et al.
5,217,391 A 6/1993 Fisher, Jr.
5,217,393 A 6/1993 Del Negro et al.
5,221,216 A 6/1993 Gabany et al.
5,227,587 A 7/1993 Paterek
5,247,424 A 9/1993 Harris et al.
5,269,701 A 12/1993 Leibfried, Jr.
5,283,853 A 2/1994 Szegda
5,284,449 A 2/1994 Vaccaro
5,294,864 A 3/1994 Do
5,295,864 A 3/1994 Birch et al.
5,316,494 A 5/1994 Flanagan et al.
5,318,459 A 6/1994 Shields
5,334,032 A 8/1994 Myers et al.
5,334,051 A 8/1994 Devine et al.
5,338,225 A 8/1994 Jacobsen et al.
5,342,218 A 8/1994 McMills et al.
5,354,217 A 10/1994 Gabel et al.
5,362,250 A 11/1994 McMills et al.
5,371,819 A 12/1994 Szegda
5,371,821 A 12/1994 Szegda
5,371,827 A 12/1994 Szegda
5,380,211 A 1/1995 Kawagauchi et al.
5,389,005 A 2/1995 Kodama
5,393,244 A 2/1995 Szegda
5,397,252 A 3/1995 Wang 5,413,504 A 5/1995 Kloecker et al.
5,431,583 A 7/1995 Szegda
5,435,745 A 7/1995 Booth
5,439,386 A 8/1995 Ellis et al.
5,444,810 A 8/1995 Szegda
5,455,548 A 10/1995 Grandchamp et al.
5,456,611 A 10/1995 Henry et al.
5,456,614 A 10/1995 Szegda
5,466,173 A 11/1995 Down
5,470,257 A 11/1995 Szegda
5,474,478 A 12/1995 Ballog
5,490,033 A 2/1996 Cronin
5,490,801 A 2/1996 Fisher, Jr. et al.
5,494,454 A 2/1996 Johnsen
5,499,934 A 3/1996 Jacobsen et al.
5,501,616 A 3/1996 Holliday
5,516,303 A 5/1996 Yohn et al.
5,525,076 A 6/1996 Down
5,542,861 A 8/1996 Anhalt et al.
5,548,088 A 8/1996 Gray et al.
5,550,521 A 8/1996 Bernaud et al.
5,564,938 A 10/1996 Shenkal et al.
5,571,028 A 11/1996 Szegda
5,586,910 A 12/1996 Del Negro et al.
5,595,499 A 1/1997 Zander et al.
5,598,132 A 1/1997 Stabile
5,607,325 A 3/1997 Toma
5,620,339 A 4/1997 Gray et al.
5,632,637 A 5/1997 Diener
5,632,651 A 5/1997 Szegda
5,644,104 A 7/1997 Porter et al.
5,651,698 A 7/1997 Locati et al.
5,651,699 A 7/1997 Holliday
5,653,605 A 8/1997 Woehl et al.
5,667,405 A 9/1997 Holliday
5,681,172 A 10/1997 Moldenhauer
5,683,263 A 11/1997 Hse
5,702,263 A 12/1997 Baumann et al.
5,722,856 A 3/1998 Fuchs et al.
5,735,704 A 4/1998 Anthony
5,746,617 A 5/1998 Porter, Jr. et al.
5,746,619 A 5/1998 Harting et al.
5,769,652 A 6/1998 Wider
5,775,927 A 7/1998 Wider
5,863,220 A 1/1999 Holliday
5,877,452 A 3/1999 McConnell
5,879,191 A 3/1999 Burris
5,882,226 A 3/1999 Bell et al.
5,921,793 A 7/1999 Phillips
5,938,465 A 8/1999 Fox, Sr.
5,944,548 A 8/1999 Saito
5,957,716 A 9/1999 Buckley et al.
5,967,852 A 10/1999 Follingstad et al.
5,975,949 A 11/1999 Holliday et al.
5,975,951 A 11/1999 Burris et al.
5,977,841 A 11/1999 Lee et al.
5,997,350 A 12/1999 Burris et al.
6,010,349 A 1/2000 Porter, Jr.
6,019,635 A 2/2000 Nelson
6,022,237 A 2/2000 Esh
6,032,358 A 3/2000 Wild
6,042,422 A 3/2000 Youtsey
6,048,229 A 4/2000 Lazaro, Jr.
6,053,769 A 4/2000 Kubota et al.
6,053,777 A 4/2000 Boyle
6,083,053 A 7/2000 Anderson, Jr. et al.
6,089,903 A 7/2000 Stafford Gray et al.
6,089,912 A 7/2000 Tallis et al.
6,089,913 A 7/2000 Holliday
6,123,567 A 9/2000 McCarthy
6,146,197 A 11/2000 Holliday et al.
6,152,753 A 11/2000 Johnson et al.
6,153,830 A 11/2000 Montena
6,210,216 B1 4/2001 Tso-Chin et al.
6,210,222 B1 4/2001 Langham et al.
6,217,383 B1 4/2001 Holland et al.
6,239,359 B1 5/2001 Lilienthal, II et al.
6,241,553 B1 6/2001 Hsia
6,261,126 B1 7/2001 Stirling
6,267,612 B1 7/2001 Arcykiewicz et al.
6,271,464 B1 8/2001 Cunningham
6,331,123 B1 12/2001 Rodrigues
6,332,815 B1 12/2001 Bruce
6,358,077 B1 3/2002 Young
D458,904 S 6/2002 Montena
6,406,330 B2 6/2002 Bruce
D460,739 S 7/2002 Fox
D460,740 S 7/2002 Montena
D460,946 S 7/2002 Montena
D460,947 S 7/2002 Montena
D460,948 S 7/2002 Montena
6,422,900 B1 7/2002 Hogan
6,425,782 B1 7/2002 Holland
D461,166 S 8/2002 Montena
D461,167 S 8/2002 Montena
D461,778 S 8/2002 Fox
D462,058 S 8/2002 Montena
D462,060 S 8/2002 Fox
6,439,899 B1 8/2002 Muzslay et al.
D462,327 S 9/2002 Montena
6,468,100 B1 10/2002 Meyer et al.
6,491,546 B1 12/2002 Perry
D468,696 S 1/2003 Montena
6,506,083 B1 1/2003 Bickford et al.
6,530,807 B2 3/2003 Rodrigues et al.
6,540,531 B2 4/2003 Syed et al.
6,558,194 B2 5/2003 Montena
6,572,419 B2 6/2003 Feye-Homann
6,576,833 B2 6/2003 Covaro et al.
6,619,876 B2 9/2003 Vaitkus et al.
6,634,906 B1 10/2003 Yeh
6,676,446 B2 1/2004 Montena
6,683,253 B1 1/2004 Lee
6,692,285 B2 2/2004 Islam
6,692,286 B1 2/2004 De Cet
6,712,631 B1 3/2004 Youtsey
6,716,041 B2 4/2004 Ferderer et al.
6,716,062 B1 4/2004 Palinkas et al.
6,733,336 B1 5/2004 Montena et al.
6,733,337 B2 5/2004 Kodaira
6,767,248 B1 7/2004 Hung
6,769,926 B1 8/2004 Montena
6,780,068 B2 8/2004 Bartholoma et al.
6,786,767 B1 9/2004 Fuks et al.
6,790,081 B2 9/2004 Burris et al.
6,805,584 B1 10/2004 Chen
6,817,896 B2 11/2004 Derenthal
6,848,939 B2 2/2005 Stirling
6,848,940 B2 2/2005 Montena
6,884,113 B1 4/2005 Montena
6,884,115 B2 4/2005 Malloy
6,929,508 B1 8/2005 Holland
6,939,169 B2 9/2005 Islam et al.
6,971,912 B2 12/2005 Montena et al.
7,029,326 B2 4/2006 Montena
7,070,447 B1 7/2006 Montena
7,086,897 B2 8/2006 Montena
7,097,499 B1 8/2006 Purdy
7,102,868 B2 9/2006 Montena
7,114,990 B2 10/2006 Bence et al.
7,118,416 B2 10/2006 Montena et al.
7,125,283 B1 10/2006 Lin
7,131,868 B2 11/2006 Montena
7,144,271 B1 12/2006 Burris et al.
7,147,509 B1 12/2006 Burris et al.
7,156,696 B1 1/2007 Montena
7,161,785 B2 1/2007 Chawgo
7,229,303 B2 6/2007 Vermoesen et al.
7,252,546 B1 8/2007 Holland
7,255,598 B2 8/2007 Montena et al.
7,299,550 B2 11/2007 Montena
7,375,533 B2 5/2008 Gale
7,393,245 B2 7/2008 Palinkas et al.
7,404,737 B1 7/2008 Youtsey
7,452,239 B2 11/2008 Montena
7,455,550 B1 11/2008 Sykes
7,462,068 B2 12/2008 Amidon
7,476,127 B1 1/2009 Wei

| | | | | |
|---|---|---|---|---|
| 7,479,035 | B2 | 1/2009 | Bence et al. | |
| 7,488,210 | B1 | 2/2009 | Burris et al. | |
| 7,494,355 | B2 | 2/2009 | Hughes et al. | |
| 7,497,729 | B1 | 3/2009 | Wei | |
| 7,507,117 | B2 | 3/2009 | Amidon | |
| 7,544,094 | B1 | 6/2009 | Paglia et al. | |
| 7,566,236 | B2 | 7/2009 | Malloy et al. | |
| 7,607,942 | B1 | 10/2009 | Van Swearingen | |
| 7,674,132 | B1 | 3/2010 | Chen | |
| 7,682,177 | B2 | 3/2010 | Berthet | |
| 7,727,011 | B2 | 6/2010 | Montena et al. | |
| 7,753,705 | B2 | 7/2010 | Montena | |
| 7,753,727 | B1 | 7/2010 | Islam et al. | |
| 7,794,275 | B2 | 9/2010 | Rodrigues | |
| 7,806,714 | B2 | 10/2010 | Williams et al. | |
| 7,806,725 | B1 | 10/2010 | Chen | |
| 7,811,133 | B2 | 10/2010 | Gray | |
| 7,824,216 | B2 | 11/2010 | Purdy | |
| 7,828,595 | B2 | 11/2010 | Mathews | |
| 7,830,154 | B2 | 11/2010 | Gale | |
| 7,833,053 | B2 | 11/2010 | Mathews | |
| 7,845,976 | B2 | 12/2010 | Mathews | |
| 7,845,978 | B1 | 12/2010 | Chen | |
| 7,850,487 | B1 | 12/2010 | Wei | |
| 7,857,661 | B1 | 12/2010 | Islam | |
| 7,887,354 | B2 | 2/2011 | Holliday | |
| 7,892,004 | B2 | 2/2011 | Hertzler et al. | |
| 7,892,005 | B2 | 2/2011 | Haube | |
| 7,892,024 | B1 | 2/2011 | Chen | |
| 7,927,135 | B1 | 4/2011 | Wlos | |
| 7,950,958 | B2 | 5/2011 | Mathews | |
| 7,955,126 | B2 | 6/2011 | Bence et al. | |
| 7,972,158 | B2 | 7/2011 | Wild et al. | |
| 8,029,315 | B2 | 10/2011 | Purdy et al. | |
| 8,062,044 | B2 | 11/2011 | Montena et al. | |
| 8,075,338 | B1 | 12/2011 | Montena | |
| 8,079,860 | B1 | 12/2011 | Zraik | |
| 8,152,551 | B2 | 4/2012 | Zraik | |
| 8,167,635 | B1 | 5/2012 | Mathews | |
| 8,167,636 | B1 | 5/2012 | Montena | |
| 8,167,646 | B1 | 5/2012 | Mathews | |
| 8,172,612 | B2 | 5/2012 | Bence et al. | |
| 8,192,237 | B2 | 6/2012 | Purdy et al. | |
| 8,231,412 | B2 | 7/2012 | Paglia et al. | |
| 8,337,229 | B2 * | 12/2012 | Montena | 439/322 |
| 2002/0013088 | A1 | 1/2002 | Rodrigues et al. | |
| 2002/0038720 | A1 | 4/2002 | Kai et al. | |
| 2003/0214370 | A1 | 11/2003 | Allison et al. | |
| 2003/0224657 | A1 | 12/2003 | Malloy | |
| 2004/0077215 | A1 | 4/2004 | Palinkas et al. | |
| 2004/0102089 | A1 | 5/2004 | Chee | |
| 2004/0209516 | A1 | 10/2004 | Burris et al. | |
| 2004/0219833 | A1 | 11/2004 | Burris et al. | |
| 2004/0229504 | A1 | 11/2004 | Liu | |
| 2005/0042919 | A1 | 2/2005 | Montena | |
| 2005/0208827 | A1 | 9/2005 | Burris et al. | |
| 2005/0233636 | A1 | 10/2005 | Rodrigues et al. | |
| 2006/0099853 | A1 | 5/2006 | Sattele et al. | |
| 2006/0110977 | A1 | 5/2006 | Matthews | |
| 2006/0154519 | A1 | 7/2006 | Montena | |
| 2007/0026734 | A1 | 2/2007 | Bence et al. | |
| 2007/0049113 | A1 | 3/2007 | Rodrigues et al. | |
| 2007/0123101 | A1 | 5/2007 | Palinkas | |
| 2007/0155232 | A1 | 7/2007 | Burris et al. | |
| 2007/0175027 | A1 | 8/2007 | Khemakhem et al. | |
| 2007/0243759 | A1 | 10/2007 | Rodrigues et al. | |
| 2007/0243762 | A1 | 10/2007 | Burke et al. | |
| 2008/0102696 | A1 | 5/2008 | Montena | |
| 2008/0289470 | A1 | 11/2008 | Aston | |
| 2009/0029590 | A1 | 1/2009 | Sykes et al. | |
| 2009/0098770 | A1 | 4/2009 | Bence et al. | |
| 2010/0055978 | A1 | 3/2010 | Montena | |
| 2010/0081321 | A1 | 4/2010 | Malloy et al. | |
| 2010/0081322 | A1 | 4/2010 | Malloy et al. | |
| 2010/0105246 | A1 | 4/2010 | Burris et al. | |
| 2010/0233901 | A1 | 9/2010 | Wild et al. | |
| 2010/0233902 | A1 | 9/2010 | Youtsey | |
| 2010/0255720 | A1 | 10/2010 | Radzik et al. | |
| 2010/0255721 | A1 | 10/2010 | Purdy et al. | |
| 2010/0279548 | A1 | 11/2010 | Montena et al. | |
| 2010/0297871 | A1 | 11/2010 | Haube | |
| 2010/0297875 | A1 | 11/2010 | Purdy | |
| 2011/0021072 | A1 | 1/2011 | Purdy | |
| 2011/0027039 | A1 | 2/2011 | Blair | |
| 2011/0053413 | A1 | 3/2011 | Mathews | |
| 2011/0117774 | A1 | 5/2011 | Malloy et al. | |
| 2011/0143567 | A1 | 6/2011 | Purdy et al. | |
| 2011/0230089 | A1 | 9/2011 | Amidon et al. | |
| 2011/0230091 | A1 | 9/2011 | Krenceski et al. | |
| 2012/0021642 | A1 | 1/2012 | Zraik | |
| 2012/0094532 | A1 | 4/2012 | Montena | |
| 2012/0145454 | A1 | 6/2012 | Montena | |
| 2012/0202378 | A1 | 8/2012 | Krenceski et al. | |
| 2013/0102189 | A1 * | 4/2013 | Montena | 439/578 |

FOREIGN PATENT DOCUMENTS

| | | | |
|---|---|---|---|
| CN | 201149937 | Y | 11/2008 |
| CN | 201178228 | Y | 1/2009 |
| DE | 47931 | C | 10/1888 |
| DE | 102289 | C | 4/1899 |
| DE | 1117687 | B | 11/1961 |
| DE | 1191880 | | 4/1965 |
| DE | 1515398 | B1 | 4/1970 |
| DE | 2225764 | A1 | 12/1972 |
| DE | 2221936 | A1 | 11/1973 |
| DE | 2261973 | A1 | 6/1974 |
| DE | 3211008 | A1 | 10/1983 |
| DE | 9001608.4 | U1 | 4/1990 |
| DE | 4439852 | A1 | 5/1996 |
| DE | 19957518 | A1 | 9/2001 |
| EP | 116157 | A1 | 8/1984 |
| EP | 167738 | A2 | 1/1986 |
| EP | 0072104 | A1 | 2/1986 |
| EP | 0265276 | A2 | 4/1988 |
| EP | 0428424 | A2 | 5/1991 |
| EP | 1191268 | A1 | 3/2002 |
| EP | 1501159 | A1 | 1/2005 |
| EP | 1548898 | | 6/2005 |
| EP | 1701410 | A2 | 9/2006 |
| FR | 2232846 | A1 | 1/1975 |
| FR | 2234680 | A2 | 1/1975 |
| FR | 2312918 | | 12/1976 |
| FR | 2462798 | A1 | 2/1981 |
| FR | 2494508 | A1 | 5/1982 |
| GB | 589697 | A | 6/1947 |
| GB | 1087228 | A | 10/1967 |
| GB | 1270846 | A | 4/1972 |
| GB | 1401373 | A | 7/1975 |
| GB | 2019665 | A | 10/1979 |
| GB | 2079549 | A | 1/1982 |
| GB | 2252677 | A | 8/1992 |
| GB | 2264201 | A | 8/1993 |
| GB | 2331634 | A | 5/1999 |
| JP | 4503793 | B2 | 1/2002 |
| JP | 2002075556 | A | 3/2002 |
| JP | 3280369 | B2 | 5/2002 |
| KR | 2006100622526 | B1 | 9/2006 |
| TW | 427044 | B | 3/2001 |
| WO | 8700351 | | 1/1987 |
| WO | 0186756 | A1 | 11/2001 |
| WO | 02069457 | A1 | 9/2002 |
| WO | 2004013883 | A2 | 2/2004 |
| WO | 2006081141 | A1 | 8/2006 |
| WO | 2011128665 | A1 | 10/2011 |
| WO | 2011128666 | A1 | 10/2011 |
| WO | 2012061379 | A2 | 5/2012 |

OTHER PUBLICATIONS

Office Action (Mail Date: Mar. 29, 2013) for U.S. Appl. No. 13/712,470, filed Dec. 12, 2012.

PCT/US2011/057939 Date of Mailing: May 2, 2012 International Search Report and Written Opinion. pp. 10.

Office Action (Mail Date: Apr. 12, 2013) for U.S. Appl. No. 13/712,498, filed Dec. 12, 2012.

* cited by examiner

CONNECTOR HAVING A NUT-BODY CONTINUITY ELEMENT AND METHOD OF USE THEREOF

CROSS-REFERENCE TO RELATED APPLICATION

This continuation application claims the priority benefit of U.S. Application No. 13/712,498, filed Dec. 12, 2012, and entitled CONNECTOR HAVING A NUT-BODY CONTINUITY ELEMENT AND METHOD OF USE THEREOF, which is a Continuation claiming priority to U.S. Non-Provisional application Ser. No. 13/016,114 filed Jan. 28, 2011, now U.S. Pat. No. 8,337,229 issued Dec. 25, 2012, and entitled CONNECTOR HAVING A NUT-BODY CONTINUITY ELEMENT AND METHOD OF USE THEREOF, which claims the priority benefit of U.S. Provisional Application No. 61/412,611 filed Nov. 11, 2010, and entitled CONNECTOR HAVING A NUT-BODY CONTINUITY ELEMENT AND METHOD OF USE THEREOF.

FIELD OF TECHNOLOGY

The following disclosure relates generally to the field of connectors for coaxial cables. More particularly, to embodiments of a coaxial cable connector having a continuity member that extends electrical continuity through the connector.

BACKGROUND

Broadband communications have become an increasingly prevalent form of electromagnetic information exchange and coaxial cables are common conduits for transmission of broadband communications. Connectors for coaxial cables are typically connected onto complementary interface ports to electrically integrate coaxial cables to various electronic devices. In addition, connectors are often utilized to connect coaxial cables to various communications modifying equipment such as signal splitters, cable line extenders and cable network modules.

To help prevent the introduction of electromagnetic interference, coaxial cables are provided with an outer conductive shield. In an attempt to further screen ingress of environmental noise, typical connectors are generally configured to contact with and electrically extend the conductive shield of attached coaxial cables. Moreover, electromagnetic noise can be problematic when it is introduced via the connective juncture between an interface port and a connector. Such problematic noise interference is disruptive where an electromagnetic buffer is not provided by an adequate electrical and/or physical interface between the port and the connector.

Accordingly, there is a need in the field of coaxial cable connectors for an improved connector design.

SUMMARY

The present invention provides an apparatus for use with coaxial cable connections that offers improved reliability.

A first general aspect relates generally to a coaxial cable connector comprising a connector body attached to a post, wherein the connector body has a first end and a second end, a port coupling element rotatable about the post, the port coupling element separated from the connector body by a distance, and a continuity element positioned between the port coupling element and the connector body proximate the second end of the connector body, wherein the continuity element establishes and maintains electrical continuity between the connector body and the port coupling element.

A second general aspect relates generally to a coaxial cable connector comprising a connector body attached to a post, the connector body having a first end and a second end, wherein the connector body includes an annular outer recess proximate the second end, a port coupling element rotatable about the post, wherein the port coupling element has an internal lip, and a continuity element having a first surface axially separated from a second surface, the first surface contacting the internal lip of the port coupling element and the second surface contacting the outer annular recess of the connector body, wherein the continuity element facilitates grounding of a coaxial cable through the connector.

A third general aspect relates generally to a coaxial cable connector comprising a connector body attached to a post, the connector body having a first end and opposing second end, wherein the connector body includes an annular outer recess proximate the second end, a port coupling element rotatable about the post, wherein the port coupling element has an internal lip, and a means for establishing and maintaining physical and electrical communication between the connector body and the port coupling element.

A fourth general aspect relates generally to a coaxial cable connector comprising a connector body attached to a post, the connector body having a first end and a second end, wherein the connector body includes an annular outer recess proximate the second end, a port coupling element rotatable about the post, wherein the port coupling element has an inner surface, and a continuity element having a first surface and a second surface, the first surface contacting the inner surface of the port coupling element and the second surface contacting the outer annular recess of the connector body, wherein the continuity element establishes and maintains electrical communication between the port coupling element and the connector body in a radial direction.

A fifth general aspect relates generally to a method for facilitating grounding of a coaxial cable through the connector, comprising providing a coaxial cable connector, the coaxial cable connector including: a connector body attached to a post, wherein the connector body has a first end and a second end, and a port coupling element rotatable about the post, the port coupling element separated from the connector body by a distance; and disposing a continuity element positioned between the port coupling element and the connector body proximate the second end of the connector body, wherein the continuity element establishes and maintains electrical continuity between the connector body and the port coupling element.

The foregoing and other features of the invention will be apparent from the following more particular description of various embodiments of the invention.

BRIEF DESCRIPTION OF THE DRAWINGS

Some of the embodiments of this invention will be described in detail, with reference to the following figures, wherein like designations denote like members, wherein.

DETAILED DESCRIPTION OF DRAWINGS

Figure 1:
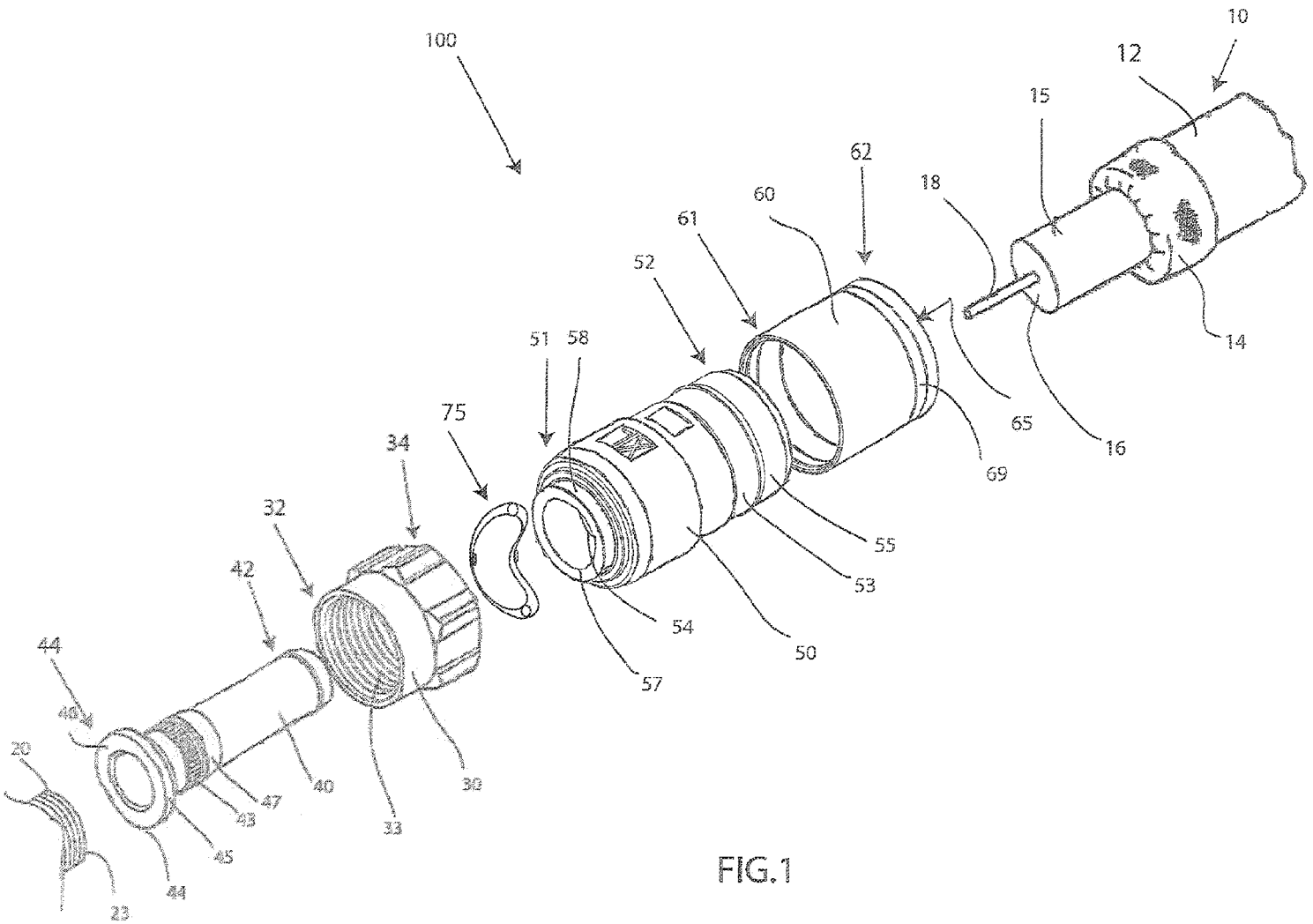
FIG. 1 depicts an exploded perspective view of an embodiment of a connector having a first embodiment of a nut-body continuity element.

Although certain embodiments of the present invention will be shown and described in detail, it should be understood that various changes and modifications may be made without departing from the scope of the appended claims. The scope of the present invention will in no way be limited to the number of constituting components, the materials thereof, the shapes thereof, the relative arrangement thereof, etc., and are disclosed simply as an example of an embodiment. The features and advantages of the present invention are illustrated in detail in the accompanying drawings, wherein like reference numerals refer to like elements throughout the drawings.

As a preface to the detailed description, it should be noted that, as used in this specification and the appended claims, the singular forms "a", "an" and "the" include plural referents, unless the context clearly dictates otherwise.

Referring to the drawings, FIG. 1 depicts one embodiment of a connector 100. The connector 100 may include a coaxial cable 10 having a protective outer jacket 12, a conductive grounding shield 14 or shields 14, an interior dielectric 16 (potentially surrounding a conductive foil layer 15), and a center conductor 18. The coaxial cable 10 may be prepared by removing the protective outer jacket 12 and drawing back the conductive grounding shield 14 to expose a portion of the interior dielectric 16 (potentially surrounding a conductive foil layer 15). Further preparation of the embodied coaxial cable 10 may include stripping the dielectric 16 (and potential conductive foil layer 15) to expose a portion of the center conductor 18. The protective outer jacket 12 is intended to protect the various components of the coaxial cable 10 from damage which may result from exposure to dirt or moisture and from corrosion. Moreover, the protective outer jacket 12 may serve in some measure to secure the various components of the coaxial cable 10 in a contained cable design that protects the cable 10 from damage related to movement during cable installation. The conductive grounding shield 14 may be comprised of conductive materials suitable for providing an electrical ground connection. Various embodiments of the shield 14 may be employed to screen unwanted noise. For instance, the shield 14 may comprise several conductive strands formed in a continuous braid around the dielectric 16 (potentially surrounding a conductive foil layer 15). Combinations of foil and/or braided strands may be utilized wherein the conductive shield 14 may comprise a foil layer, then a braided layer, and then a foil layer. Those in the art will appreciate that various layer combinations may be implemented in order for the conductive grounding shield 14 to effectuate an electromagnetic buffer helping to prevent ingress of environmental noise that may disrupt broadband communications. Furthermore, there may be more than one grounding shield 14, such as a tri-shield or quad shield cable, and there may also be flooding compounds protecting the shield 14. The dielectric 16 may be comprised of materials suitable for electrical insulation. It should be noted that the various materials of which all the various components of the coaxial cable 10 are comprised should have some degree of elasticity allowing the cable 10 to flex or bend in accordance with traditional broadband communications standards, installation methods and/or equipment. It should further be recognized that the radial thickness of the coaxial cable 10, protective outer jacket 12, conductive grounding shield 14, interior dielectric 16 and/or center conductor 18 may vary based upon generally recognized parameters corresponding to broadband communication standards and/or equipment.

The conductive foil layer 15 may comprise a layer of foil wrapped or otherwise positioned around the dielectric 16, thus the conductive foil layer 15 may surround and/or encompass the dielectric 16. For instance, the conductive foil layer 15 may be positioned between the dielectric 16 and the shield 14. In one embodiment, the conductive foil layer 15 may be bonded to the dielectric 16. In another embodiment, the conductive foil layer 15 may be generally wrapped around the dielectric 16. The conductive foil layer 15 may provide a continuous uniform outer conductor for maintaining the coaxial condition of the coaxial cable 10 along its axial length. The coaxial cable 10 having, inter alia, a conductive foil layer 15 may be manufactured in thousands of feet of lengths. Furthermore, the conductive foil layer 15 may be manufactured to a nominal outside diameter with a plus minus tolerance on the diameter, and may be a wider range than what may normally be achievable with machined, molded, or cast components. The outside diameter of the conductive foil layer 15 may vary in dimension down the length of the cable 10, thus its size may be unpredictable at any point along the cable 10. Due to this unpredictability, the contact between the post 40 and the conductive foil layer 15 may not be sufficient or adequate for conductivity or continuity throughout the connector 100. Thus, a nut-body continuity element 75 may be placed between the nut 30 and the connector body 50 to allow continuity and/or continuous physical and electrical contact or communication between the nut 30 and the connector body 50. Continuous conductive and electrical continuity between the nut 30 and the connector body 50 can be established by the physical and electrical contact between the connector body 50 and the nut-body continuity element 75, wherein the nut-body continuity element 75 is simultaneously in physical and electrical contact with the nut 30. While operably configured, electrical continuity may be established and maintained throughout the connector 100 and to interface port 20 via the conductive foil layer 15 which contacts the conductive grounding shield 14, which contacts the connector body 50, which contacts the nut-body continuity element 75, which contacts the nut 30, the nut 30 being advanced onto interface port 20. Alternatively, electrical continuity can be established and maintained throughout the connector 100 via the conductive foil layer 15, which contacts the post 40, which contacts the connector body 50, which contacts the nut-body continuity element 75, which contacts the nut 30, the nut 30 being advanced onto interface port 20.

Referring further to FIG. 1, the connector 100 may make contact with a coaxial cable interface port 20. The coaxial cable interface port 20 includes a conductive receptacle 22 for receiving a portion of a coaxial cable center conductor 18 sufficient to make adequate electrical contact. The coaxial cable interface port 20 may further comprise a threaded exterior surface 24. However, various embodiments may employ a smooth surface, as opposed to threaded exterior surface. In addition, the coaxial cable interface port 20 may comprise a mating edge 26. It should be recognized that the radial thickness and/or the length of the coaxial cable interface port 20 and/or the conductive receptacle 22 may vary based upon generally recognized parameters corresponding to broadband communication standards and/or equipment. Moreover, the pitch and height of threads which may be formed upon the threaded exterior surface 24 of the coaxial cable interface port 20 may also vary based upon generally recognized parameters corresponding to broadband communication standards and/or equipment. Furthermore, it should be noted that the interface port 20 may be formed of a single conductive material, multiple conductive materials, or may be configured with both conductive and non-conductive materials corresponding to the port's 20 electrical interface with a connector 100. For example, the threaded exterior surface may be fabricated from a conductive material, while the material comprising the mating edge 26 may be non-conductive or vice versa. However, the conductive receptacle 22 should be formed of a conductive material. Further still, it will be understood by those of ordinary skill that the interface port 20 may be embodied by a connective interface component of a communications modifying device such as a signal splitter, a cable line extender, a cable network module and/or the like.

With continued reference to FIG. 1, an embodiment of the connector 100 may further comprise a nut 30, a post 40, a connector body 50, a fastener member 60, and a nut-body continuity element 75. The nut-body continuity element 75 should be formed of a conductive material. Such conductive materials may include, but are not limited to conductive polymers, conductive plastics, conductive elastomers, conductive elastomeric mixtures, composite materials having conductive properties, metal, soft metals, conductive rubber, and/or the like and/or any operable combination thereof. The nut-body continuity element 75 may be resilient, flexible, elastic, etc., or may be rigid and/or semi-rigid. The nut-body continuity element 75 may have a circular, rectangular, square, or any appropriate geometrically dimensioned cross-section. For example, the nut-body continuity element 75 may have a flat rectangular cross-section similar to a metal washer or wave washer. The nut-body continuity element 75 may also be a conductive element, conductive member, continuity element, a conductive ring, a conductive wave ring, a continuity ring, a continuity wave ring, a resilient member, and the like.

Figure 2B:
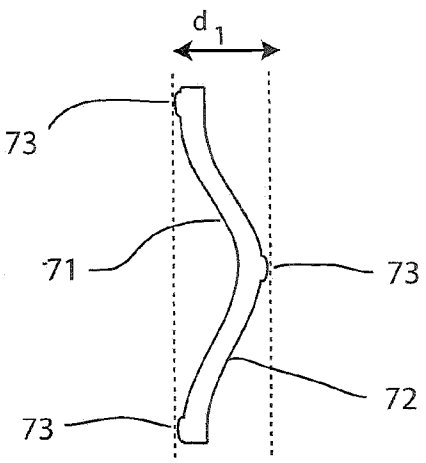
FIG. 2B depicts a second side view of a first embodiment of a nut-body continuity element.
Figure 2A:
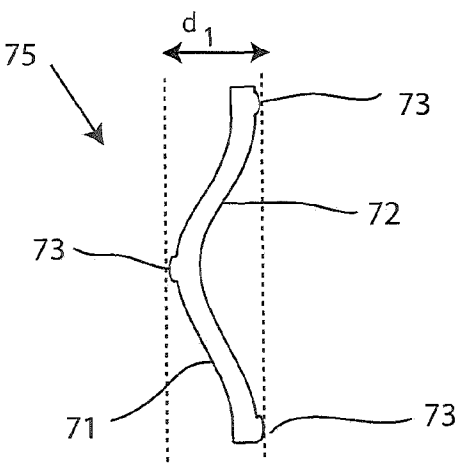
FIG. 2A depicts a first side view of a first embodiment of a nut-body continuity element.
Figure 2C:
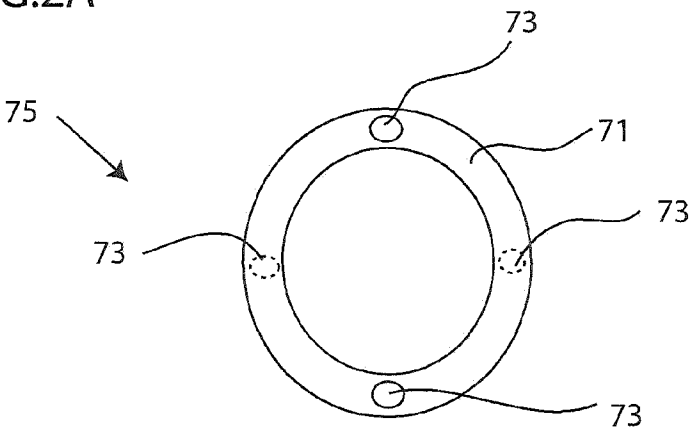
FIG. 2C depicts a front view of a first embodiment of a nut-body continuity element.

Referring to the drawings, FIGS. 2A-2C depict further embodiments of a nut-body continuity element 75, specifically, embodiments of a structure and/or design of a nut-body continuity element 75. For example, the nut-body continuity element 75 may comprise a substantially circinate torus or toroid structure. Moreover, nut-body continuity element 75 may have a slight bend to provide axial separation between contact points. For instance, the point on first surface 71 of the nut-body continuity element 75 contacting the nut 30 may be an axial distance, $d_1$, away from the point on the second surface 72 of the nut-body continuity element 75 contacting the connector body 50. To facilitate contact with the connector body 50 and with the nut 30, the nut-body continuity element 75 may have one or more bumps 73 located on the surface of the nut-body continuity element 75. Bumps 73 may be any protrusion from the surface of the nut-body continuity element 75 that can facilitate the contact of the nut 30 and the connector body 50. The surface of the nut-body continuity element 75 can comprise a first surface 71 and a second surface 72; bumps 73 may be located on both the first surface 71 of the nut-body continuity element 75 and the second surface 72 of the nut-body continuity element 75, or just one of the first surface 71 or second surface 72. In some embodiments, the nut-body continuity element 75 does not have any bumps 73 positioned on the surface, and relies on smooth, flat contact offered by the first surface 71 and/or second surface 72. Because of the shape and design of the nut-body continuity element 75 (i.e. because of the bended configuration), the nut-body continuity element 75 should make contact with the nut 30 at two or more points along the first surface 71, and should also make contact with the connector body 50 at two or more points along the second surface 72. Depending on the angle of curvature of the bend, the nut-body continuity element 75 may contact the nut 30 and the connector body 50 at multiple or single locations along the first surface 71 and second surface 72 of the nut-body continuity element 75. The angle of curvature of the bend of the nut-body continuity element 75 may vary, including a nut-body continuity element 75 with little to no axial separation.

Furthermore, a bended configuration of the nut-body continuity element 75 can allow a portion of the nut-body continuity element 75 to physically contact the nut 30 and another portion of the nut-body continuity element 75 to contact the connector body 50 in a biasing relationship. For instance, the bend in the nut-body continuity element 75 can allow deflection of the element when subjected to an external force, such as a force exerted by the nut 30 (e.g. internal lip 36) or the connector body 50 (e.g. outer annular recess 56). The biasing relationship between the nut 30, the connector body 50, and the nut-body continuity element 75, evidenced by the deflection of the nut-body continuity element 75, establishes and maintains constant contact between the nut 30, the connector body 50, and the nut-body continuity element 75. The constant contact may establish and maintain electrical continuity through a connector 100. A bend in the nut-body continuity element 75 may also be a wave, a compression, a deflection, a contour, a bow, a curve, a warp, a deformation, and the like. Those skilled in the art should appreciate the various resilient shapes and variants of elements the nut-body continuity element 75 may encompass to establish and maintain electrical communication between the nut 30 and the connector body 50.

Figure 3:
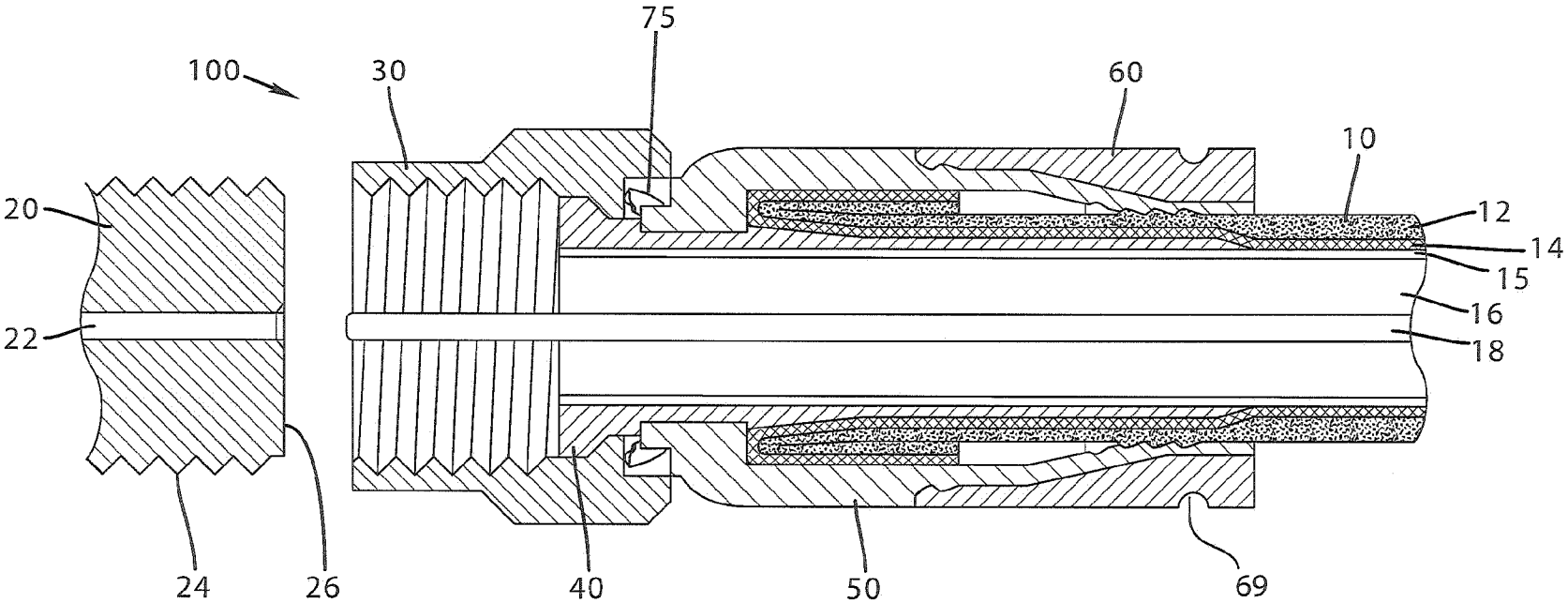
FIG. 3 depicts a sectional side view of an embodiment of a connector having a first embodiment of a nut-body continuity element.

Referring still to the drawings, FIG. 3 depicts an embodiment of a connector 100 having a nut-body continuity element 75. The nut-body continuity element 75 may be disposed and/or placed between the nut 30 and the connector body 50. For example, the nut-body continuity element 75 may be configured to cooperate with the annular recess 56 proximate the second end 54 of connector body 50 and the cavity 38 extending axially from the edge of second end 34 and partially defined and bounded by an outer internal wall 39 of threaded nut 30 (see FIG. 6) such that the continuity element 75 may make contact with and/or reside contiguous with the annular recess 56 of connector body 50 and may make contact with and/or reside contiguous with the mating edge 37 of threaded nut 30. Moreover, a portion of the nut-body continuity element 75 can reside inside and/or contact the cavity 38 proximate a second end 32 of the nut, while another portion of the same nut-body continuity element 75 contacts an outer annular recess 56 proximate the second end 54. Alternatively, the nut-body continuity element 75 may have a radial relationship with the post 40, proximate the second 44 of the post 40. For example, the nut-body continuity element 75 may be radially disposed a distance above the post 40. However, the placement of the nut-body continuity element 75 in all embodiments does not restrict or prevent the nut 30 (port coupling element) from freely rotating, in particular, rotating about the stationary post 40. In some embodiments, the nut-body continuity element 75 may be configured to rotate or spin with the nut 30, or against the nut 30. In many embodiments, the nut-body continuity element 75 is stationary with respect to the nut 30. In other embodiments, the nut-body continuity element 75 may be press-fit into position between the nut 30 and the connector body 50. Furthermore, those skilled in the art would appreciate that the nut-body continuity element 75 may be fabricated by extruding, coating, molding, injecting, cutting, turning, elastomeric batch processing, vulcanizing, mixing, stamping, casting, and/or the like and/or any combination thereof in order to provide efficient production of the component.

Furthermore, the nut-body continuity element 75 need not be radially disposed 360° around the post 40, or extend, reside contiguous, etc., 360° around the outer annular recess 56 or cavity 38. For example, the nut-body continuity element 75 may be radially disposed only a portion of 360° around the post 40, or extend only a portion of 360° around the outer annular recess 56 or cavity 38. Specifically, the nut-body continuity element 75 may be formed in the shape of a half circle, crescent, half moon, semi-circle, C-shaped, and the like. As long as the nut-body continuity element 75 physically contacts the nut 30 and the connector body 50, physical and electrical continuity may be established and maintained. In a semi-circular embodiment of the nut-body continuity element 75, the first surface 71 of the nut-body continuity element 75 can physically contact the internal lip 36 of nut 30 at least once, while simultaneously contacting the outer annular recess 56 of the connector body 50 at least once. Thus, electrical continuity between the connector body 50 and the nut 30 may be established and maintained by implementation of various embodiments of the nut-body continuity element 75.

For instance, through various implementations of embodiments of the nut-body continuity element 75, physical and electrical communication or contact between the nut 30 and the nut-body continuity element 75, wherein the nut-body continuity element 75 simultaneously contacts the connector body 50 may help transfer the electricity or current from the post 40 (i.e. through conductive communication of the grounding shield 14) to the nut 30 and to the connector body 50, which may ground the coaxial cable 10 when the nut 30 is in electrical or conductive communication with the coaxial cable interface port 20. In many embodiments, the nut-body continuity element 75 axially contacts the nut 30 and the connector body 50. In other embodiments, the nut-body continuity element 75 radially contacts the nut 30 and the connector body 50.

Figure 4:
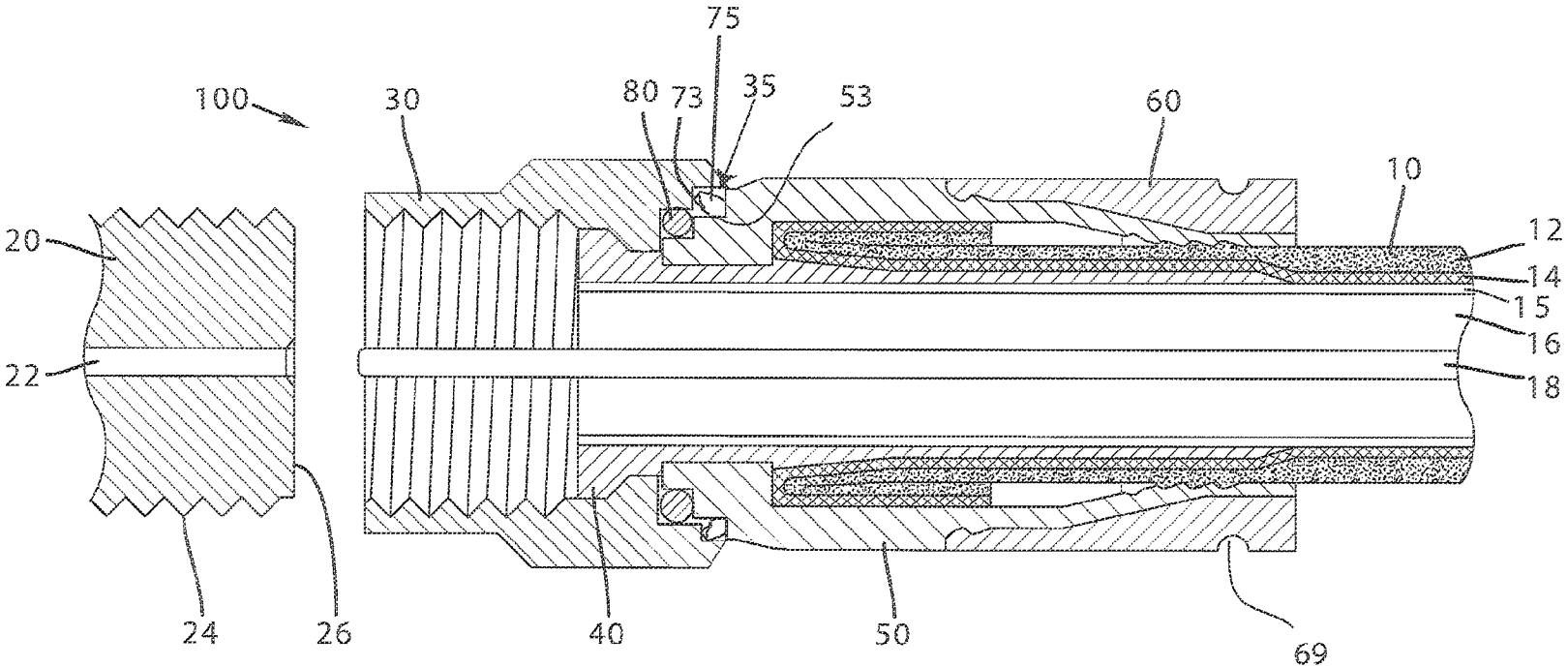
FIG. 4 depicts a sectional side view of an embodiment of a connector having a first embodiment of a nut-body continuity element and a conductive element.
Figure 5:
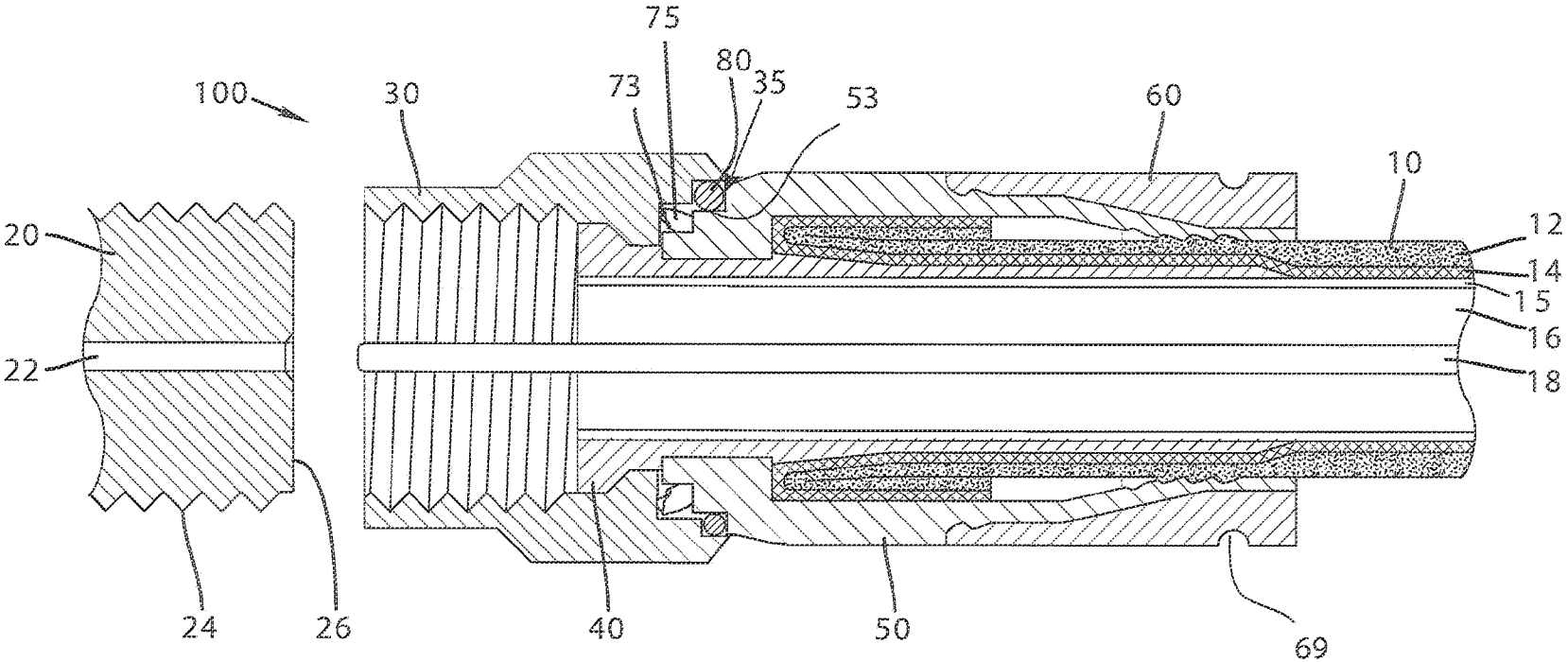
FIG. 5 depicts a sectional side view of an embodiment of a connector having a first embodiment of a nut-body continuity element inboard of a conductive element.

FIG. 4 depicts an embodiment of the connector 100 which may comprise a nut 30, a post 40, a connector body 50, a fastener member 60, a nut-body continuity element 75, and a connector body conductive member 80 proximate the second end 54 of the connector body 50. The nut-body continuity element 75 may reside in additional cavity 35 proximate the second end 32 of the nut 30 and additional annular recess 53 proximate the second end 54 of the connector body 50. The connector body conductive member 80 should be formed of a conductive material. Such materials may include, but are not limited to conductive polymers, plastics, elastomeric mixtures, composite materials having conductive properties, soft metals, conductive rubber, and/or the like and/or any workable combination thereof. The connector body conductive member 80 may comprise a substantially circinate torus or toroid structure, or other ring-like structure. For example, an embodiment of the connector body conductive member 80 may be an O-ring configured to cooperate with the annular recess 56 proximate the second end 54 of connector body 50 and the cavity 38 extending axially from the edge of second end 34 and partially defined and bounded by an outer internal wall 39 of threaded nut 30 (see FIG. 6) such that the connector body conductive O-ring 80 may make contact with and/or reside contiguous with the annular recess 56 of connector body 50 and outer internal wall 39 of threaded nut 30 when operably attached to post 40 of connector 100. The connector body conductive member 80 may facilitate an annular seal between the threaded nut 30 and connector body 50 thereby providing a physical barrier to unwanted ingress of moisture and/or other environmental contaminates. Moreover, the connector body conductive member 80 may further facilitate electrical coupling of the connector body 50 and threaded nut 30 by extending therebetween an unbroken electrical circuit. In addition, the connector body conductive member 80 may facilitate grounding of the connector 100, and attached coaxial cable (shown in FIG. 1), by extending the electrical connection between the connector body 50 and the threaded nut 30. Furthermore, the connector body conductive member 80 may effectuate a buffer preventing ingress of electromagnetic noise between the threaded nut 30 and the connector body 50. It should be recognized by those skilled in the relevant art that the connector body conductive member 80 may be manufactured by extruding, coating, molding, injecting, cutting, turning, elastomeric batch processing, vulcanizing, mixing, stamping, casting, and/or the like and/or any combination thereof in order to provide efficient production of the component. Therefore, the combination of the connector body conductive member 80 and the nut-body continuity element 75 may further electrically couple the nut 30 and the connector body 50 to establish and maintain electrical continuity throughout connector 100. However, the positioning and location of these components may swap. For instance, FIG. 5 depicts an embodiment of a connector 100 having a nut-body continuity element 75 inboard of connector body conductive member 80.

Figure 6:
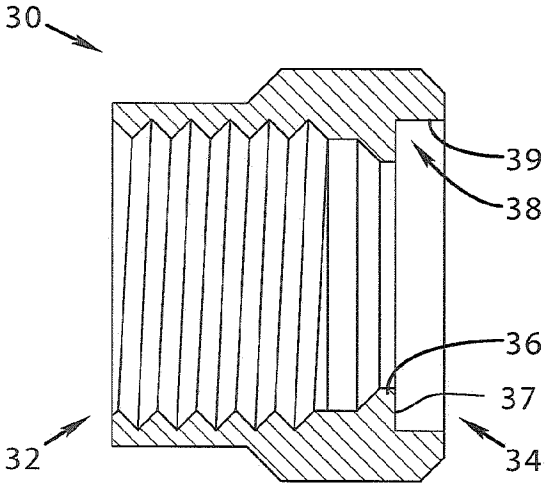
FIG. 6 depicts a sectional side view of an embodiment of a nut.

With additional reference to the drawings, FIG. 6 depicts a sectional side view of an embodiment of a nut 30 having a first end 32 and opposing second end 34. The nut 30 (or port coupling element, coupling element, coupler) may be rotatably secured to the post 40 to allow for rotational movement about the post 40. The nut 30 may comprise an internal lip 36 located proximate the second end 34 and configured to hinder axial movement of the post 40 (shown in FIG. 7). The lip 36 may include a mating edge 37 which may contact the post 40 while connector 100 is operably configured. Furthermore, the threaded nut 30 may comprise a cavity 38 extending axially from the edge of second end 34 and partial defined and bounded by the internal lip 36. The cavity 38 may also be partially defined and bounded by an outer internal wall 39. The threaded nut 30 may be formed of conductive materials facilitating grounding through the nut 30. Accordingly the nut 30 may be configured to extend an electromagnetic buffer by electrically contacting conductive surfaces of an interface port 20 when a connector 100 (shown in FIG. 3) is advanced onto the port 20. In addition, the threaded nut 30 may be formed of non-conductive material and function only to physically secure and advance a connector 100 onto an interface port 20. Moreover, the threaded nut 30 may be formed of both conductive and non-conductive materials. For example the internal lip 36 may be formed of a polymer, while the remainder of the nut 30 may be comprised of a metal or other conductive material. In addition, the threaded nut 30 may be formed of metals or polymers or other materials that would facilitate a rigidly formed body. Manufacture of the threaded nut 30 may include casting, extruding, cutting, turning, tapping, drilling, injection molding, blow molding, or other fabrication methods that may provide efficient production of the component. Those in the art should appreciate the various embodiments of the nut 30 may also comprise a coupler member having no threads, but being dimensioned for operable connection to a corresponding to an interface port, such as interface port 20.

Additionally, nut 30 may contain an additional cavity 35, formed similarly to cavity 38. In some embodiments that include an additional cavity 35, a secondary internal lip 33 should be formed to provide a surface for the contact and/or interference with the nut-body continuity element 75. For example, the nut-body continuity element 75 may be configured to cooperate with the additional annular recess 53 proximate the second end 54 of connector body 50 and the additional cavity 35 extending axially from the edge of second end 34 and partially defined and bounded by the secondary internal lip 33 of threaded nut 30 (see FIGS. 5-6) such that the nut-body continuity element 75 may make contact with and/or reside contiguous with the additional annular recess 53 of connector body 50 and the secondary internal lip 33 of threaded nut 30 (see FIG. 4). In some embodiments, there may be an additional recess, 35, and 53; however, the nut-body continuity element 75 may be positioned as embodied in FIG. 5.

Figure 7:
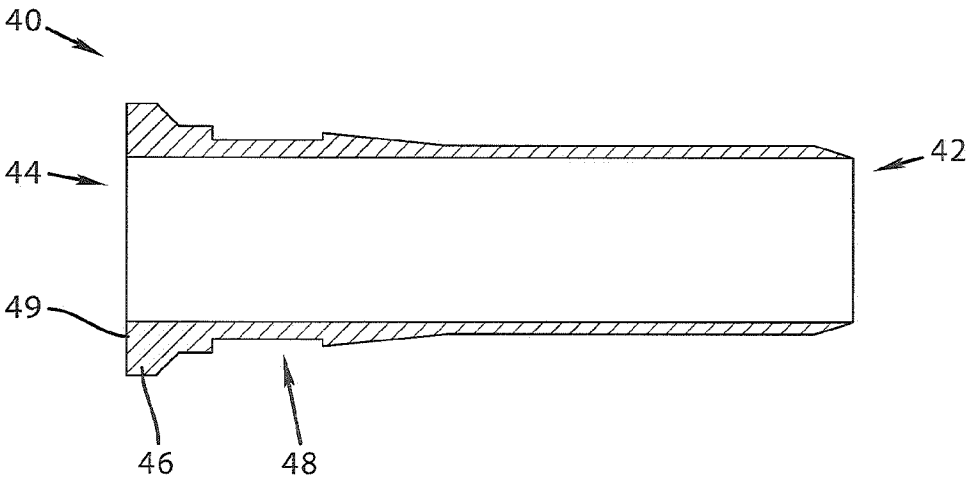
FIG. 7 depicts a sectional side view of an embodiment of a post.

With further reference to the drawings, FIG. 7 depicts a sectional side view of an embodiment of a post 40 in accordance with the present invention. The post 40 may comprise a first end 42 and opposing second end 44. Furthermore, the post 40 may comprise a flange 46 operably configured to contact internal lip 36 of threaded nut 30 (shown in FIG. 6) thereby facilitating the prevention of axial movement of the post beyond the contacted internal lip 36. Further still, an embodiment of the post 40 may include a surface feature 48 such as a shallow recess, detent, cut, slot, or trough. Additionally, the post 40 may include a mating edge 49. The mating edge 49 may be configured to make physical and/or electrical contact with an interface port 20 or mating edge member (shown in FIG. 1) or O-ring 70 (shown in FIGS. 11-12). The post 40 should be formed such that portions of a prepared coaxial cable 10 including the dielectric 16, conductive foil layer 15, and center conductor 18 (shown in FIGS. 1 and 2) may pass axially into the first end 42 and/or through the body of the post 40. Moreover, the post 40 should be dimensioned such that the post 40 may be inserted into an end of the prepared coaxial cable 10, around the conductive foil layer surrounding the dielectric 16, and under the protective outer jacket 12 and conductive grounding shield 14. Accordingly, where an embodiment of the post 40 may be inserted into an end of the prepared coaxial cable 10 under the drawn back conductive grounding shield 14 substantial physical and/or electrical contact with the shield 14 may be accomplished thereby facilitating grounding through the post 40. The post 40 may be formed of metals or other conductive materials that would facilitate a rigidly formed body. In addition, the post 40 may also be formed of non-conductive materials such as polymers or composites that facilitate a rigidly formed body. In further addition, the post may be formed of a combination of both conductive and non-conductive materials. For example, a metal coating or layer may be applied to a polymer of other non-conductive material. Manufacture of the post 40 may include casting, extruding, cutting, turning, drilling, injection molding, spraying, blow molding, or other fabrication methods that may provide efficient production of the component.

Figure 8:
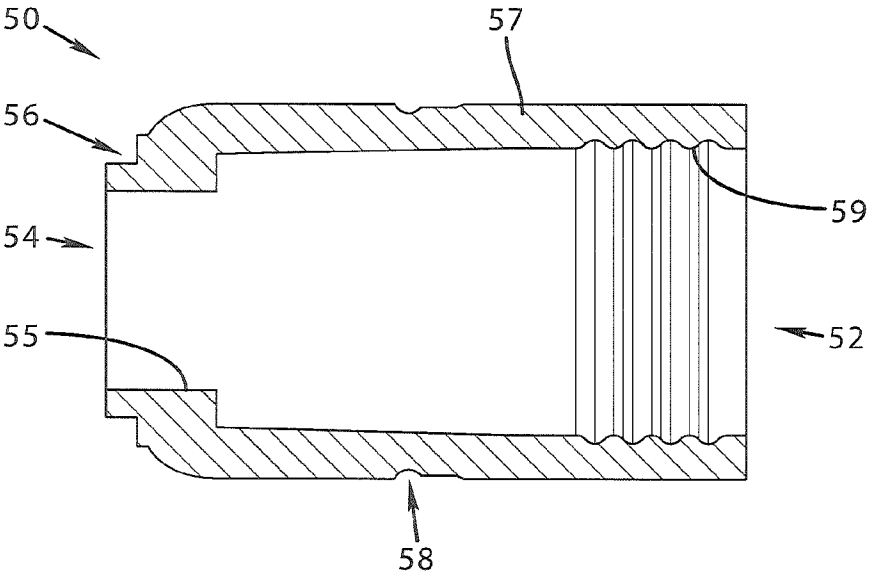
FIG. 8 depicts a sectional side view of an embodiment of a connector body.

With continued reference to the drawings, FIG. 8 depicts a sectional side view of a connector body 50. The connector body 50 may comprise a first end 52 and opposing second end 54. Moreover, the connector body 50 may include an internal annular lip 55 configured to mate and achieve purchase with the surface feature 48 of post 40 (shown in FIG. 7). In addition, the connector body 50 may include an outer annular recess 56 located proximate the second end 54. Furthermore, the connector body may include a semi-rigid, yet compliant outer surface 57, wherein the surface 57 may include an annular detent 58. The outer surface 57 may be configured to form an annular seal when the first end 52 is deformably compressed against a received coaxial cable 10 by a fastener member 60 (shown in FIG. 3). Further still, the connector body 50 may include internal surface features 59, such as annular serrations formed proximate the first end 52 of the connector body 50 and configured to enhance frictional restraint and gripping of an inserted and received coaxial cable 10. The connector body 50 may be formed of materials such as, polymers, bendable metals or composite materials that facilitate a semi-rigid, yet compliant surface 57. Further, the connector body 50 should be formed of conductive materials, or a combination of conductive and non-conductive materials such that electrical continuity can be established between the connector body 50 and the nut 30, facilitated by the nut-body continuity element 75. Manufacture of the connector body 50 may include casting, extruding, cutting, turning, drilling, injection molding, spraying, blow molding, or other fabrication methods that may provide efficient production of the component.

Additionally, the connector body 50 may contain an additional annular recess 53, formed similarly to outer annular recess 56. In some embodiments, the additional annular recess 53 may provide a surface for the contact and/or interference with the nut-body continuity element 75. For example, the nut-body continuity element 75 may be configured to cooperate with the additional annular recess 53 proximate the second end 54 of connector body 50 and the additional cavity 35 extending axially from the edge of second end 34 and partially defined and bounded by the secondary internal lip 33 of threaded nut 30 (see FIGS. 5-6) such that the nut-body continuity element 75 may make contact with and/or reside contiguous with the annular recess 53 of connector body 50 and the secondary internal lip 33 of threaded nut 30 (see FIG. 4). In some embodiments, there may be an additional recess, 35, and 53; however, the nut-body continuity element 75 may be positioned as embodied in FIG. 5.

Figure 9:
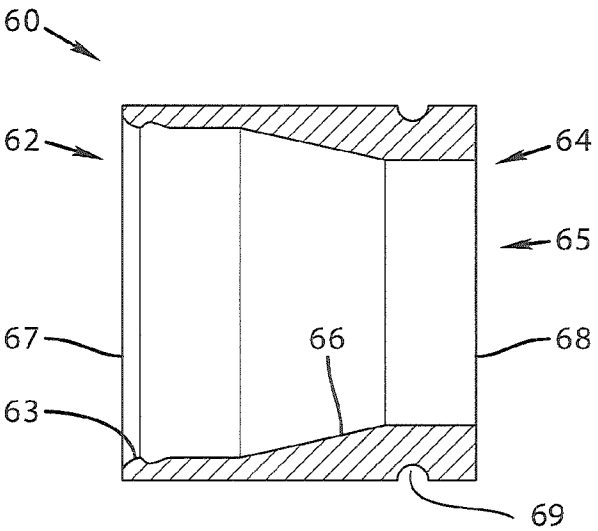
FIG. 9 depicts a sectional side view of an embodiment of a fastener member.

Referring further to the drawings, FIG. 9 depicts a sectional side view of an embodiment of a fastener member 60 in accordance with the present invention. The fastener member 60 may have a first end 62 and opposing second end 64. In addition, the fastener member 60 may include an internal annular protrusion 63 located proximate the first end 62 of the fastener member 60 and configured to mate and achieve purchase with the annular detent 58 on the outer surface 57 of connector body 50 (shown in FIG. 5). Moreover, the fastener member 60 may comprise a central passageway 65 defined between the first end 62 and second end 64 and extending axially through the fastener member 60. The central passageway 65 may comprise a ramped surface 66 which may be positioned between a first opening or inner bore 67 having a first diameter positioned proximate with the first end 62 of the fastener member 60 and a second opening or inner bore 68 having a second diameter positioned proximate with the second end 64 of the fastener member 60. The ramped surface 66 may act to deformably compress the inner surface 57 of a connector body 50 when the fastener member 60 is operated to secure a coaxial cable 10 (shown in FIG. 3). Additionally, the fastener member 60 may comprise an exterior surface feature 69 positioned proximate with the second end 64 of the fastener member 60. The surface feature 69 may facilitate gripping of the fastener member 60 during operation of the connector 100 (see FIG. 3). Although the surface feature is shown as an annular detent, it may have various shapes and sizes such as a ridge, notch, protrusion, knurling, or other friction or gripping type arrangements. It should be recognized, by those skilled in the requisite art, that the fastener member 60 may be formed of rigid materials such as metals, polymers, composites and the like. Furthermore, the fastener member 60 may be manufactured via casting, extruding, cutting, turning, drilling, injection molding, spraying, blow molding, or other fabrication methods that may provide efficient production of the component.

Figure 10:
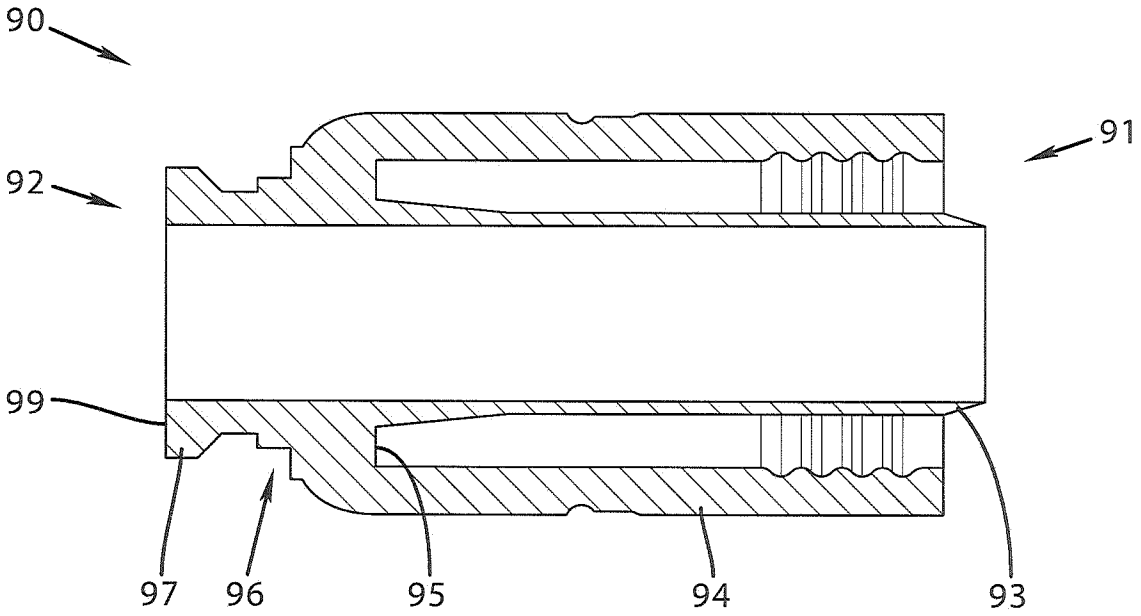
FIG. 10 depicts a sectional side view of an embodiment of a connector body having an integral post.

Referring still further to the drawings, FIG. 10 depicts a sectional side view of an embodiment of an integral post connector body 90 in accordance with the present invention. The integral post connector body 90 may have a first end 91 and opposing second end 92. The integral post connector body 90 physically and functionally integrates post and connector body components of an embodied connector 100 (shown in FIG. 1). Accordingly, the integral post connector body 90 includes a post member 93. The post member 93 may render connector operability similar to the functionality of post 40 (shown in FIG. 7). For example, the post member 93 of integral post connector body 90 may include a mating edge 99 configured to make physical and/or electrical contact with an interface port 20 (shown in FIG. 1) or mating edge member or O-ring 70 (shown in FIGS. 11-12). The post member 93 of integral should be formed such that portions of a prepared coaxial cable 10 including the dielectric 16, conductive foil layer 15, and center conductor 18 (shown in FIG. 1) may pass axially into the first end 91 and/or through the post member 93. Moreover, the post member 93 should be dimensioned such that a portion of the post member 93 may be inserted into an end of the prepared coaxial cable 10, around the dielectric 16 and conductive foil layer 15, and under the protective outer jacket 12 and conductive grounding shield 14 or shields 14. Further, the integral post connector body 90 includes a connector body surface 94. The connector body surface 94 may render connector 100 operability similar to the functionality of connector body 50 (shown in FIG. 8). Hence, inner connector body surface 94 should be semi-rigid, yet compliant. The outer connector body surface 94 may be configured to form an annular seal when compressed against a coaxial cable 10 by a fastener member 60 (shown in FIG. 3). In addition, the integral post connector body 90 may include an interior wall 95. The interior wall 95 may be configured as an unbroken surface between the post member 93 and outer connector body surface 94 of integral post connector body 90 and may provide additional contact points for a conductive grounding shield 14 of a coaxial cable 10. Furthermore, the integral post connector body 90 may include an outer recess formed proximate the second end 92. Further still, the integral post connector body 90 may comprise a flange 97 located proximate the second end 92 and operably configured to contact internal lip 36 of threaded nut 30 (shown in FIG. 6) thereby facilitating the prevention of axial movement of the integral post connector body 90 with respect to the threaded nut 30, yet still allowing rotational movement of the axially secured nut 30. The integral post connector body 90 may be formed of materials such as, polymers, bendable metals or composite materials that facilitate a semi-rigid, yet compliant outer connector body surface 94. Additionally, the integral post connector body 90 may be formed of conductive or non-conductive materials or a combination thereof. Manufacture of the integral post connector body 90 may include casting, extruding, cutting, turning, drilling, injection molding, spraying, blow molding, or other fabrication methods that may provide efficient production of the component.

Figure 11:
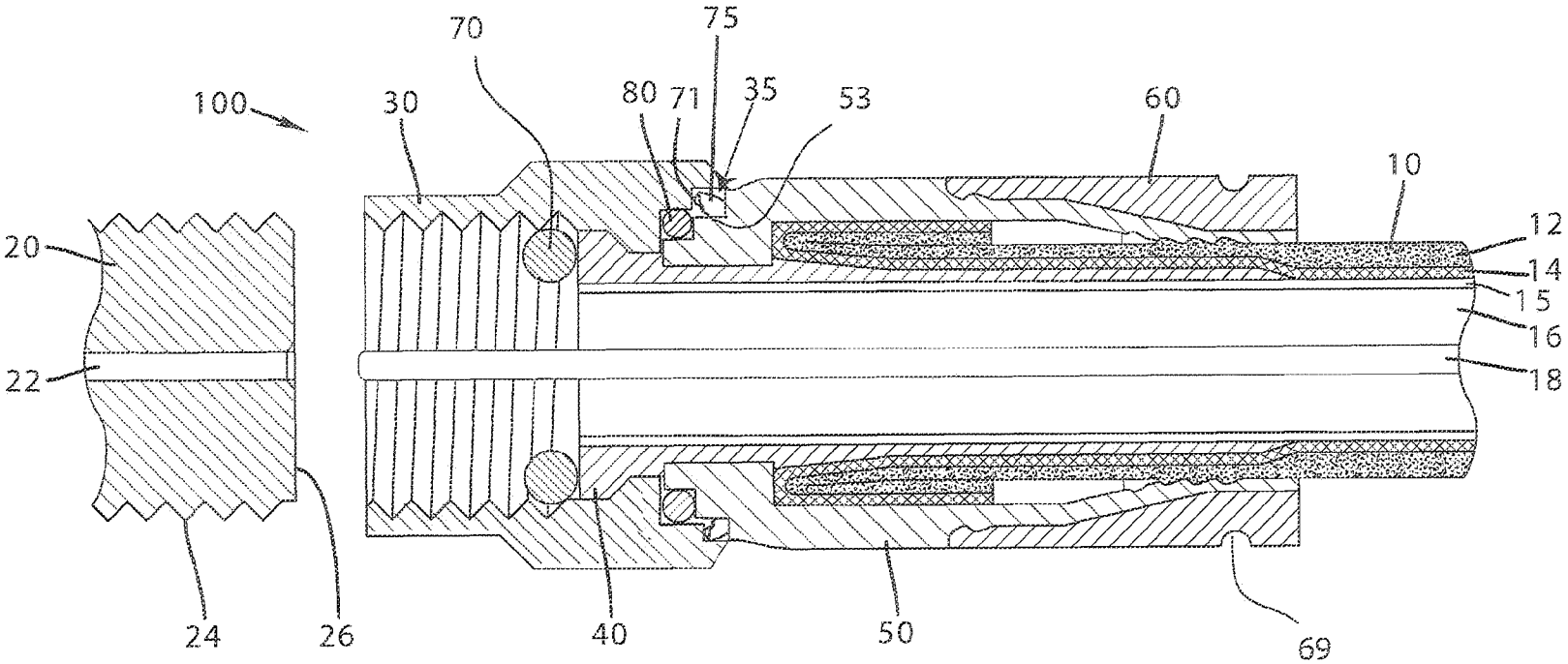
FIG. 11 depicts a sectional side view of an embodiment of a connector configured having a first embodiment of a nut-body continuity element with more than one continuity element proximate a second end of a post.
Figure 12:
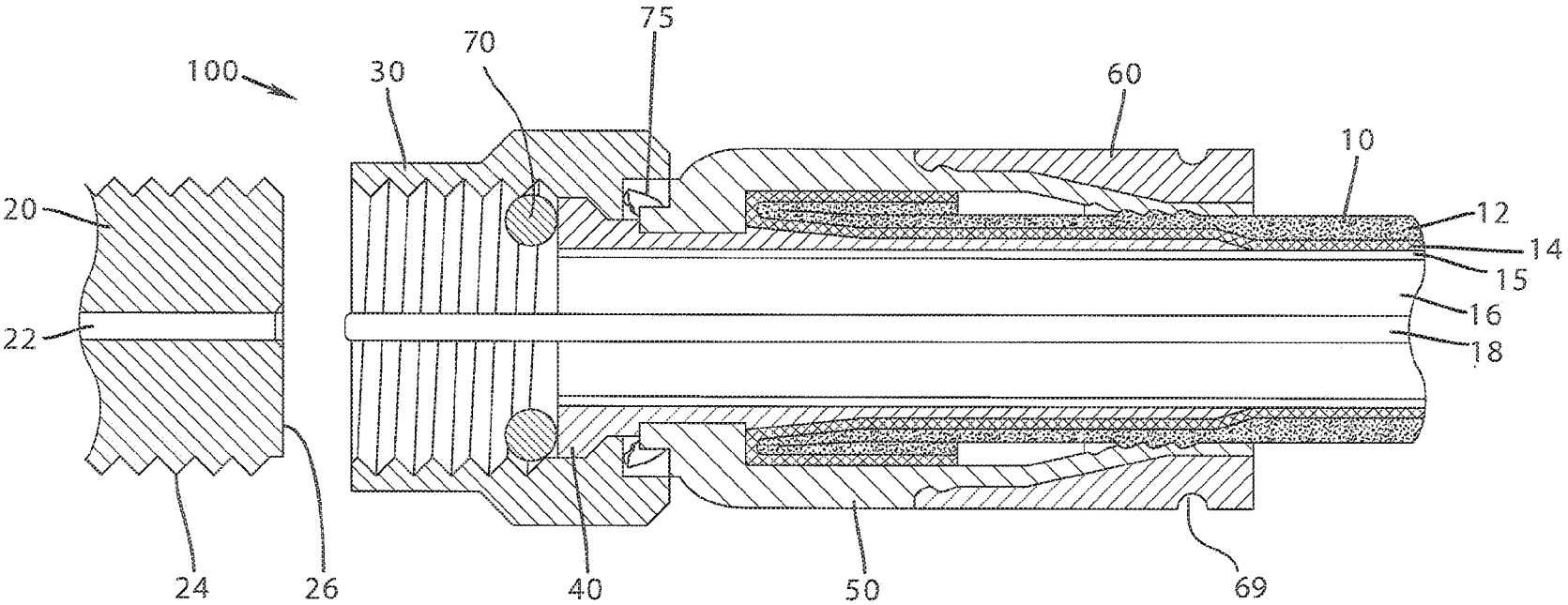
FIG. 12 depicts a sectional side view of an embodiment of a connector configured with a conductive member proximate a second end of a connector body, and a first embodiment of a nut-body continuity element.
Figure 13:
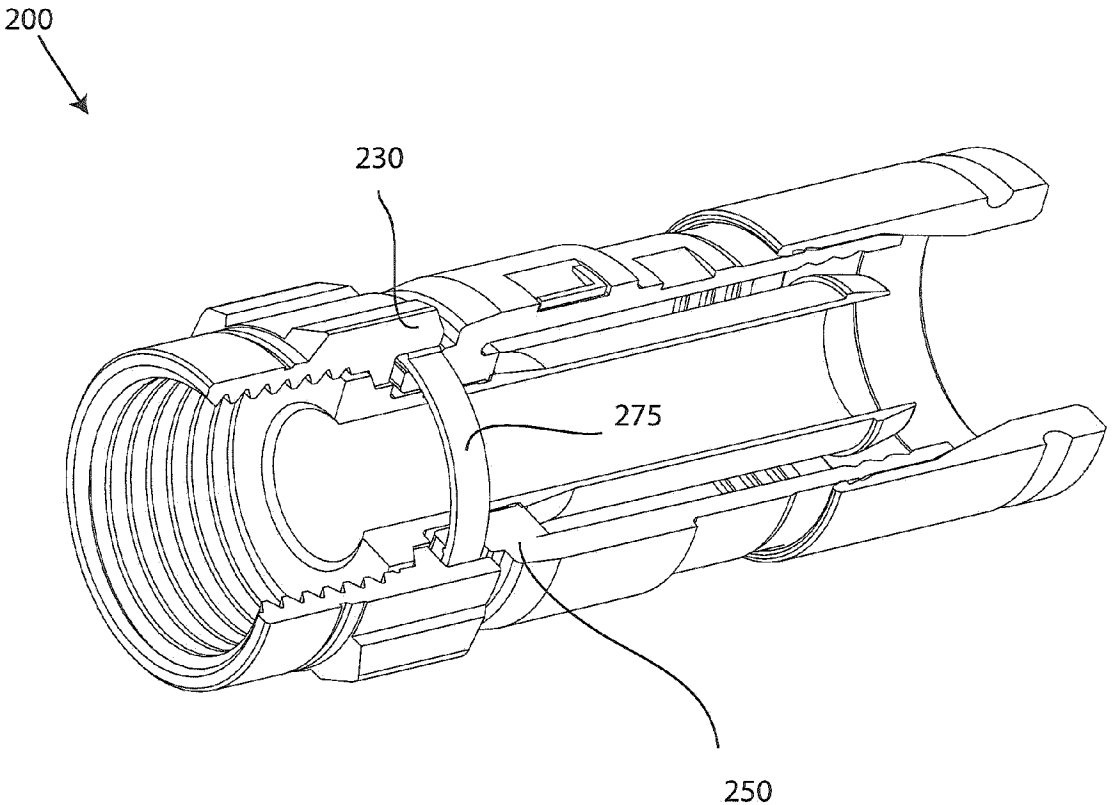
FIG. 13 depicts a perspective cut away view of an embodiment of a connector having a second embodiment of a nut-body continuity element.
Figure 15:
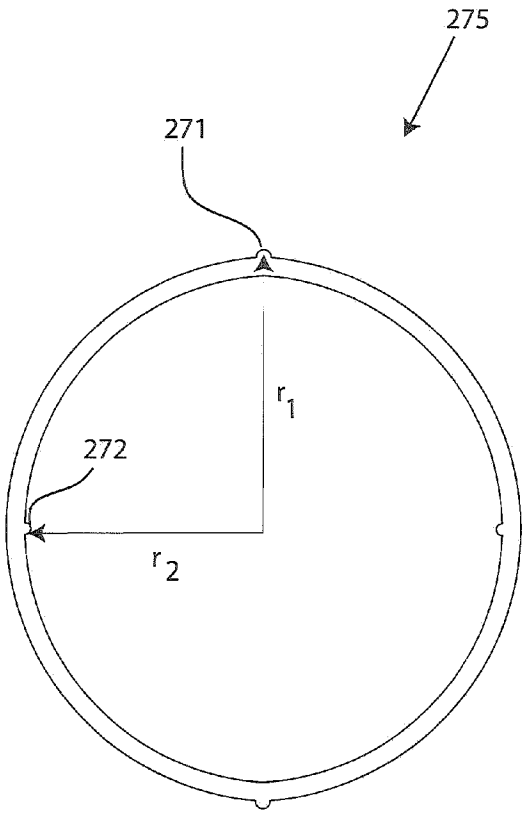
FIG. 15 depicts a front view of a second embodiment of a nut-body continuity element.
Figure 14:
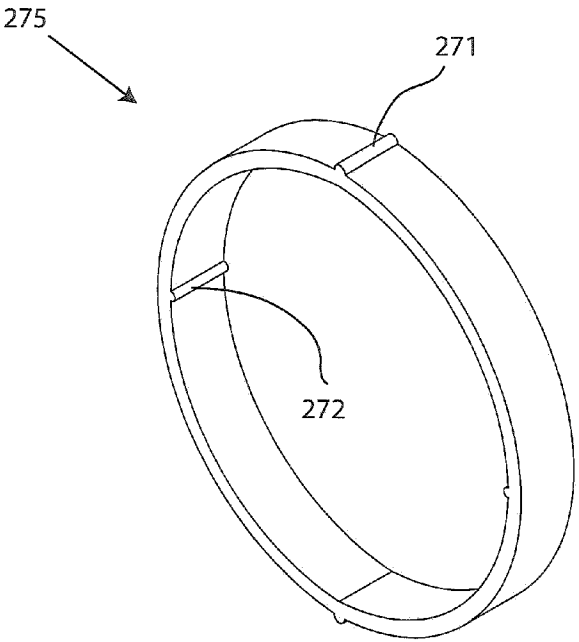
FIG. 14 depicts a perspective view of a second embodiment of a nut-body continuity element.
Figure 16:
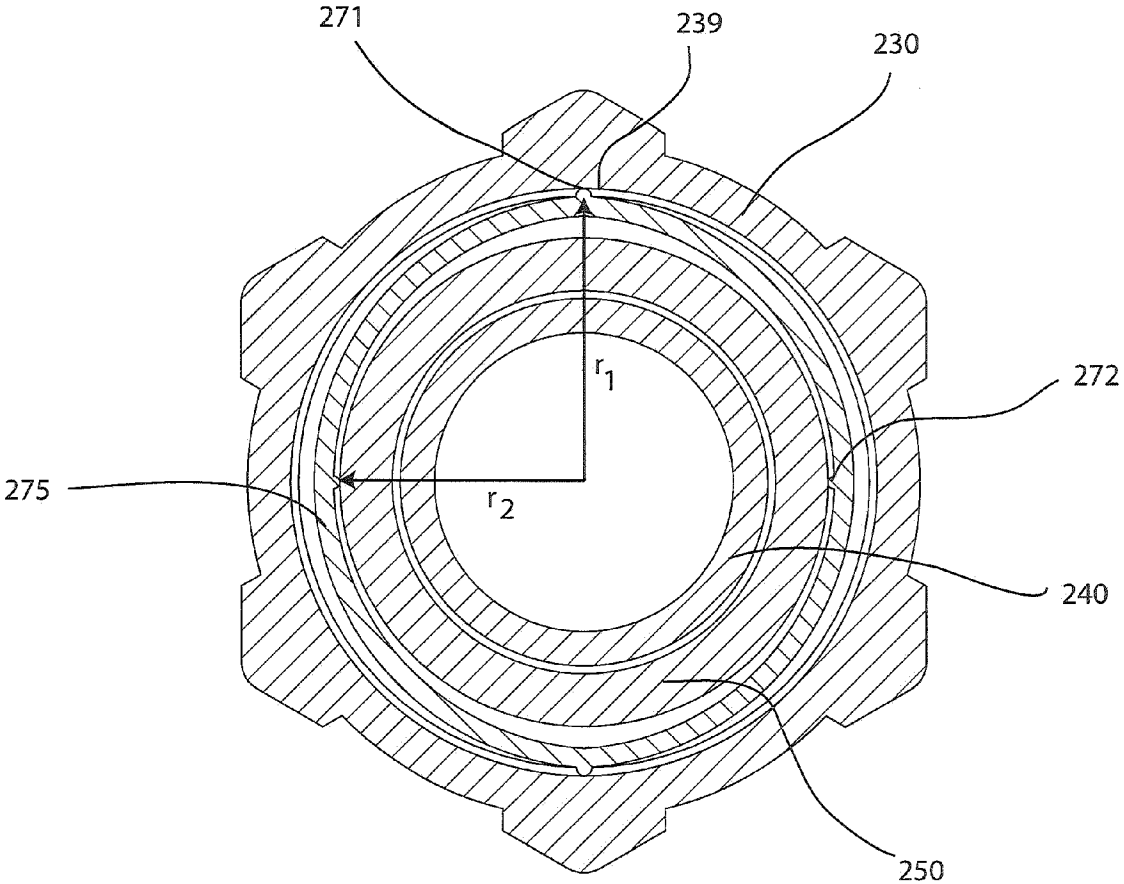
FIG. 16 depicts a cross-sectional end view of an embodiment of a connector having a second embodiment of a nut-body continuity element.

With continued reference to the drawings, FIG. 11 depicts a sectional side view of an embodiment of a connector 100 configured with a mating edge conductive member 70 proximate a second end 44 of a post 40, and a nut-body continuity element 75 located proximate a second end 54 of the connector body 50, and a connector body conductive member 80 (as described supra). The mating edge conductive member 70 should be formed of a conductive material. Such materials may include, but are not limited to conductive polymers, conductive plastics, conductive elastomers, conductive elastomeric mixtures, composite materials having conductive properties, soft metals, conductive rubber, and/or the like and/or any operable combination thereof. The mating edge conductive member 70 may comprise a substantially circinate torus or toroid structure adapted to fit within the internal threaded portion of threaded nut 30 such that the mating edge conductive member 70 may make contact with and/or reside continuous with a mating edge 49 of a post 40 when operably attached to post 40 of connector 100. For example, one embodiment of the mating edge conductive member 70 may be an O-ring. The mating edge conductive member 70 may facilitate an annular seal between the threaded nut 30 and post 40 thereby providing a physical barrier to unwanted ingress of moisture and/or other environmental contaminates. Moreover, the mating edge conductive member 70 may facilitate electrical coupling of the post 40 and threaded nut 30 by extending therebetween an unbroken electrical circuit. In addition, the mating edge conductive member 70 may facilitate grounding of the connector 100, and attached coaxial cable (shown in FIG. 3), by extending the electrical connection between the post 40 and the threaded nut 30. Furthermore, the mating edge conductive member 70 may effectuate a buffer preventing ingress of electromagnetic noise between the threaded nut 30 and the post 40. The mating edge conductive member or O-ring 70 may be provided to users in an assembled position proximate the second end 44 of post 40, or users may themselves insert the mating edge conductive O-ring 70 into position prior to installation on an interface port 20 (shown in FIG. 1). Those skilled in the art would appreciate that the mating edge conductive member 70 may be fabricated by extruding, coating, molding, injecting, cutting, turning, elastomeric batch processing, vulcanizing, mixing, stamping, casting, and/or the like and/or any combination thereof in order to provide efficient production of the component. FIG. 12 depicts an embodiment of a connector 100 having a mating edge conductive member 70 proximate a second end 44 of a post 40, and a nut-body continuity element 75 located proximate a second end 54 of the connector body 50, without the presence of connector body conductive member 80.

With reference to the drawings, either one or all three of the nut-body continuity element 75, the mating edge conductive member, or O-ring 70, and connector body conductive member, or O-ring 80, may be utilized in conjunction with an integral post connector body 90. For example, the mating edge conductive member 70 may be inserted within a threaded nut 30 such that it contacts the mating edge 99 of integral post connector body 90 as implemented in an embodiment of connector 100. By further example, the connector body conductive member 80 may be position to cooperate and make contact with the recess 96 of connector body 90 and the outer internal wall 39 (see FIG. 6) of an operably attached threaded nut 30 of an embodiment of a connector 100. Those in the art should recognize that embodiments of the connector 100 may employ all three of the nut-body continuity element 75, the mating edge conductive member 70, and the connector body conductive member 80 in a single connector 100 (shown in FIG. 11). Accordingly the various advantages attributable to each of the nut-body continuity element 75, mating edge conductive member 70, and the connector body conductive member 80 may be obtained.

A method for grounding a coaxial cable 10 through a connector 100 is now described with reference to FIG. 3 which depicts a sectional side view of an embodiment of a connector 100. A coaxial cable 10 may be prepared for connector 100 attachment. Preparation of the coaxial cable 10 may involve removing the protective outer jacket 12 and drawing back the conductive grounding shield 14 to expose a portion of a conductive foil layer 15 surrounding the interior dielectric 16. Further preparation of the embodied coaxial cable 10 may include stripping the and dielectric 16 (and potential conductive foil layer 15) to expose a portion of the center conductor 18. Various other preparatory configurations of coaxial cable 10 may be employed for use with connector 100 in accordance with standard broadband communications technology and equipment. For example, the coaxial cable may be prepared without drawing back the conductive grounding shield 14, but merely stripping a portion thereof to expose the interior dielectric 16 (potentially surrounding conductive foil layer 15), and center conductor 18.

Referring again to FIG. 3, further depiction of a method for grounding a coaxial cable 10 through a connector 100 is described. A connector 100 including a post 40 having a first end 42 and second end 44 may be provided. Moreover, the provided connector may include a connector body 50 and a nut-body continuity element 75 located between the nut 30 and the connector body 50. The proximate location of the nut-body continuity element 75 should be such that the nut-body continuity element 75 makes simultaneous physical and electrical contact with the nut 30 and the connector body 50.

Grounding may be further attained and maintained by fixedly attaching the coaxial cable 10 to the connector 100. Attachment may be accomplished by insetting the coaxial cable 10 into the connector 100 such that the first end 42 of post 40 is inserted under the conductive grounding sheath or shield 14 and around the conductive foil layer 15 potentially encompassing the dielectric 16. Where the post 40 is comprised of conductive material, a grounding connection may be achieved between the received conductive grounding shield 14 of coaxial cable 10 and the inserted post 40. The ground may extend through the post 40 from the first end 42 where initial physical and electrical contact is made with the conductive grounding shield 14 to the second end 44 of the post 40. Once received, the coaxial cable 10 may be securely fixed into position by radially compressing the outer surface 57 of connector body 50 against the coaxial cable 10 thereby affixing the cable into position and sealing the connection. Furthermore, radial compression of a resilient member placed within the connector 100 may attach and/or the coaxial cable 10 to connector 100. In addition, the radial compression of the connector body 50 may be effectuated by physical deformation caused by a fastener member 60 that may compress and lock the connector body 50 into place. Moreover, where the connector body 50 is formed of materials having and elastic limit, compression may be accomplished by crimping tools, or other like means that may be implemented to permanently deform the connector body 50 into a securely affixed position around the coaxial cable 10.

As an additional step, grounding of the coaxial cable 10 through the connector 100 may be accomplished by advancing the connector 100 onto an interface port 20 until a surface of the interface port mates with a surface of the nut 30. Because the nut-body continuity element 75 is located such that it makes physical and electrical contact with the connector body 50, grounding may be extended from the post 40 or conductive foil layer 15 through the conductive grounding shield 14, then through the nut-body continuity element 75 to the nut 30, and then through the mated interface port 20. Accordingly, the interface port 20 should make physical and electrical contact with the nut 30. Advancement of the connector 100 onto the interface port 20 may involve the threading on of attached threaded nut 30 of connector 100 until a surface of the interface port 20 abuts the mating edge 49 of the post (see FIG. 7) and axial progression of the advancing connector 100 is hindered by the abutment. However, it should be recognized that embodiments of the connector 100 may be advanced onto an interface port 20 without threading and involvement of a threaded nut 30. Once advanced until progression is stopped by the conductive contact of the mating edge 49 of the post 40 with interface port 20, the connector 100 may be further shielded from ingress of unwanted electromagnetic interference. Moreover, grounding may be accomplished by physical advancement of various embodiments of the connector 100 wherein a nut-body continuity element 75 facilitates electrical connection of the connector 100 and attached coaxial cable 10 to an interface port 20.

With continued reference to FIG. 11 and additional reference to FIG. 12, further depiction of a method for grounding a coaxial cable 10 through a connector 100 is described. A connector 100 including a post 40 having a first end 42 and second end 44 may be provided. Moreover, the provided connector may include a connector body 50 and a mating edge conductive member 70 located proximate the second end 44 of post 40. The proximate location of the mating edge conductive member 70 should be such that the mating edge conductive member 70 makes physical and electrical contact with post 40. In one embodiment, the mating edge conductive member or O-ring 70 may be inserted into a threaded nut 30 until it abuts the mating edge 49 of post 40. However, other embodiments of connector 100 may locate the mating edge conductive member 70 at or very near the second end 44 of post 40 without insertion of the mating edge conductive member 70 into a threaded nut 30.

Grounding may be further attained by fixedly attaching the coaxial cable 10 to the connector 100. Attachment may be accomplished by insetting the coaxial cable 10 into the connector 100 such that the first end 42 of post 40 is inserted under the conductive grounding sheath or shield 14 and around the conductive foil layer 15 and dielectric 16. Where the post 40 is comprised of conductive material, a grounding connection may be achieved between the received conductive grounding shields 14 of coaxial cable 10 and the inserted post 40. The ground may extend through the post 40 from the first end 42 where initial physical and electrical contact is made with the conductive grounding shield 14 to the mating edge 49 located at the second end 44 of the post 40. Once, received, the coaxial cable 10 may be securely fixed into position by radially compressing the outer surface 57 of connector body 50 against the coaxial cable 10 thereby affixing the cable into position and sealing the connection. The radial compression of the connector body 50 may be effectuated by physical deformation caused by a fastener member 60 that may compress and lock the connector body 50 into place. Moreover, where the connector body 50 is formed of materials having and elastic limit, compression may be accomplished by crimping tools, or other like means that may be implemented to permanently deform the connector body 50 into a securely affixed position around the coaxial cable 10.

As an additional step, grounding of the coaxial cable 10 through the connector 100 may be accomplished by advancing the connector 100 onto an interface port 20 until a surface of the interface port mates with the mating edge conductive member 70. Because the mating edge conductive member 70 is located such that it makes physical and electrical contact with post 40, grounding may be extended from the post 40 through the mating edge conductive member 70 and then through the mated interface port 20. Accordingly, the interface port 20 should make physical and electrical contact with the mating edge conductive member 70. The mating edge conductive member 70 may function as a conductive seal when physically pressed against the interface port 20. Advancement of the connector 100 onto the interface port 20 may involve the threading on of attached threaded nut 30 of connector 100 until a surface of the interface port 20 abuts the mating edge conductive member 70 and axial progression of the advancing connector 100 is hindered by the abutment. However, it should be recognized that embodiments of the connector 100 may be advanced onto an interface port 20 without threading and involvement of a threaded nut 30. Once advanced until progression is stopped by the conductive sealing contact of mating edge conductive member 70 with interface port 20, the connector 100 may be shielded from ingress of unwanted electromagnetic interference. Moreover, grounding may be accomplished by physical advancement of various embodiments of the connector 100 wherein a mating edge conductive member 70 facilitates electrical connection of the connector 100 and attached coaxial cable 10 to an interface port 20.

A method for electrically coupling the nut 30 and the connector body 50 is now described with reference to FIGS. 1-16. The method of electrically coupling the nut 30 and the connector body 50 may include the steps of providing a connector body 50 attached to the post 40 wherein the connector body 50 includes a first end 52 and a second end 54, the first end 52 configured to deformably compress against and seal a received coaxial cable 10; a rotatable coupling element 30 attached to the post 40; and a nut-body continuity element 75 located between the connector body 50 and the rotatable coupling element 30, proximate the second end 54 of the connector body 50, wherein the nut-body continuity element 75 facilitates the grounding of the coaxial cable 10 by electrically coupling the rotatable coupling element 30 to the connector body 50, and advancing the connector 100 onto an interface port 20.

Another method for providing a coaxial cable connector is now described with references to FIGS. 1-16. The method may comprise the steps of providing a coaxial cable connector including: a connector body 50, 250 attached to a post 40, wherein the connector body 50, 250 has a first end 52 and a second end 54, and a port coupling element 30, 230 rotatable about the post 40, the port coupling element 30, 230 separated from the connector body 50, 250 by a distance; and disposing a continuity element 75, 275 positioned between the port coupling element 30, 230 and the connector body 50, 250 proximate the second end 54 of the connector body 50, 250; wherein the continuity element 75, 275 establishes and maintains electrical continuity between the connector body 50, 250 and the port coupling element 30, 230.

Referring now specifically to FIGS. 13-16, connector 200 may include a nut-body continuity element 275 placed between the nut 230 and the connector body 250 to allow continuity and/or continuous physical and electrical contact or communication between the nut 230 and the connector body 250 in the radial direction. Embodiments of connector 200 may include a connector body 250 attached to a post 240, the connector body 250 having a first end and a second end, wherein the connector body 250 includes an annular outer recess proximate the second end, a port coupling element 230 rotatable about the post 240, wherein the port coupling element 230 has an inner surface, and a continuity element 275 having a first surface 271 and a second surface 272, the first surface 271 contacting the inner surface of the port coupling element 230 and the second surface 272 contacting the outer annular recess of the connector body 250, wherein the continuity element 275 establishes and maintains electrical communication between the port coupling element 230 and the connector body 250 in a radial direction. Moreover, continuous conductive and electrical continuity between the nut 230 and the connector body 250 in the radial direction can be established by the physical and electrical contact between the connector body 250 and the nut-body continuity element 275, wherein the nut-body continuity element 275 is simultaneously in physical and electrical contact with the nut 230. Moreover, nut-body continuity element 275 may have a slight bend to provide radial separation between contact points. For instance, the point on first surface 271 of the nut-body continuity element 275 contacting the nut 230 may be of a longer radial distance, $r_1$, from the center conductor than the radial distance, $r_2$, of the point on the second surface 272 of the nut-body continuity element 275 contacting the connector body 250. In other words, the nut-body continuity element 275 may be an elliptical shape, wherein there is a major radius and a minor radius. The major radius, being larger than the minor radius, is the distance between a center of the nut-body continuity element 275 and the point where the nut-body continuity element 275 contacts the inner surface diameter of the nut 230 (i.e. internal wall 239 of nut 230). The minor radius, being smaller than the major radius, is the distance between the center of the nut-body continuity element 275 and the point where the nut-body continuity element 275 contacts the outer surface diameter of the connector body 250. Therefore, nut-body continuity element 275 may physically and electrically contact both the nut 230 and the connector body 250, despite the radial separation between the two components.

While this invention has been described in conjunction with the specific embodiments outlined above, it is evident that many alternatives, modifications and variations will be apparent to those skilled in the art. Accordingly, the embodiments of the invention as set forth above are intended to be illustrative, not limiting. Various changes may be made without departing from the spirit and scope of the invention as defined in the following claims.

What is claimed is:

1. A coaxial cable connector comprising:

a connector body having a first body end configured to face away from an interface port when the connector is in an assembled state, and a second body end configured to face toward the interface port when the connector is in the assembled state, the second body end including an inner body surface configured to engage a post when the connector is in the assembled state and an outer body surface facing away from the inner body surface;

a coupling element having a first coupling element end configured to engage the interface port when the connector is in the assembled state, and a second coupling element end configured to face away from the interface port when the connector is in the assembled state, the coupling element including:

an inner coupling element portion configured to rotatably engage an outer surface of the interface port when the connector is in the assembled state;

a radial mating edge end face surface extending along a radial direction from the inner coupling element portion and configured to face along a longitudinal direction of the connector and away from the interface port when the connector is in the assembled state; and an outer internal wall extending from the radial mating edge end face surface along the longitudinal direction of the connector and away from the interface port when the connector is in the assembled state; and a continuity element configured to be spaced away from the post and located outside the inner coupling element portion of the coupling element and outside the connector body proximate the second end of the connector body such that no portion of the continuity member is located either inside the connector body or inside the radial mating edge end face surface of the coupling element when the connector is in the assembled state, the continuity element including:

a coupling element side surface configured to face toward the interface port when the connector is in the assembled state, maintain contact with only the radial mating edge end face surface of the coupling element when the connector is in the assembled state and when the connector body and coupling element move relative to each other, and not contact the outer internal wall of the coupling element when the connector is in the assembled state; and a body engaging side surface configured to face away from the interface portion and contact only the outer body surface of the body when the connector is in the assembled state; and wherein the continuity element constantly biases the radial mating edge end face surface of the coupling element to establish and maintain continuous electrical continuity between the coupling element and the post when the connector is in the assembled state and when the coupling element rotates about a central axis of the coaxial cable connector.

2. The connector of claim 1, wherein the continuity element has a first surface and a second surface, the first surface contacting the coupling element and the second surface contacting the connector body.

3. The connector of claim 1, wherein the continuity element has at least one protrusion to facilitate the contact of the coupling element and the connector body.

4. The connector of claim 1, wherein the continuity element is resilient.

5. The connector of claim 2, wherein the continuity element includes a bended configuration, such that the first surface of the continuity element is axially separated from the second surface of the continuity element.

6. The connector of claim 2, wherein the continuity element includes an elliptical configuration, such that the first surface of the continuity element is radially separated from the second surface of the continuity element.

7. A coaxial cable connector with a body member having an inner body portion configured to engage a port when the connector is in the assembled state and an outer body portion configured to face substantially away from the inner body portion, the connector comprising:

a coupling member having a rearwardly facing mating edge portion configured to substantially face a rearward direction of the connector away from the port when the connector is in the assembled state, the rearwardly facing mating edge portion including an inward protrusion;

an external continuity member configured to be located outside the inward protrusion of the coupling member and outside the outer body portion of the body member such that no portion of the external continuity member is located either inside the body member or inside the inward protrusion of the coupling member when the connector is in the assembled state, the external continuity member including:

a coupling member contact portion configured to substantially face toward the port when the connector is in the assembled state, maintain contact with the rearwardly facing mating edge portion of the coupling member when the connector is in the assembled state; and a body member contact portion configured to maintain contact with the outer body portion of the body member when the connector is in the assembled state;

wherein the external continuity member is resilient, is not configured to form an environmental seal, is made of a substantially metallic material that is exposed to environmental materials, is configured to create a constant biasing forcing force against the rearwardly facing mating edge face portion when the connector is in the assembled state and when the coupling member and body member move relative to one another, and is configured to form a continuous metallic electrical grounding path extending between the coupling member and the body member so as to maintain electrical continuity between the body member and the coupling member when the connector is in the assembled state.

8. The connector of claim 7, further comprising a post engageable with the coupling element when the connector is in the assembled state and wherein the continuity member is configured to maintain the continuous metallic electrical grounding path extending between the coupling element and the body even when the coupling element and the post move away from and out of contact with one another.

9. The connector of claim 7, further comprising an outer wall portion extending from the rearwardly facing of the coupling member toward a rearward direction so as to form a cavity between the coupling member and the body member, and wherein the external continuity member is located in the cavity when the connector is in the assembled state.

10. The connector of claim 7, wherein the continuity member is freely movable relative to the coupling member and the connector body.

11. The connector of claim 7, wherein the continuity member is a closed revolute structure.

12. The connector of claim 11, wherein the continuity member is a conductive ring.

13. The connector of claim 11, wherein the continuity member is a wave washer.

14. The connector of claim 7, wherein the continuity member is continuity member is not a closed revolute structure.

15. The connector of claim 11, wherein the continuity member is a metal washer.

16. A method of assembling a connector comprising:

providing a body member having an outwardly facing portion;

providing a coupling member having a rearwardly facing portion extending along a substantially radial direction, and an inward protrusion extending from the rearwardly facing portion along the substantially radial direction;

providing a post member engageable with the body member and the coupling member when the connector is in an assembled state;

providing an external continuity member having a first continuity portion configured to contact the rearwardly facing portion of the coupling member when the connector is in the assembled state, and a second continuity portion configured to contact the outwardly facing portion of the body member when the connector is in the assembled state, the external continuity member being resilient;

arranging the external continuity member so as to create a constant biasing force against the rearwardly facing mating edge portion when the connector is in the assembled state and when the coupling member and body member move relative to one another to establish and maintain continuous electrical continuity between the coupling member and the post when the connector is the assembled state, even when the coupling member, the post, and the body member move away from and out of contact with one another;

arranging the external continuity member so as to be spaced away from the post member when the connector is in the assembled state; and positioning the external continuity member so as to be located outside both the rearwardly facing mating edge portion of the coupling member and the outwardly facing portion of the body member such that no portion of the external continuity member is located either inside the connector body or inside the inward protrusion of the coupling member.

17. The method of claim 16, further comprising: providing an outer wall portion extending from the rearwardly facing mating edge portion of the coupling member toward a rearward direction so as to form a cavity between the coupling member and the body member, and locating the external continuity member in the cavity when the connector is in the assembled state.

18. The method of claim 16, wherein the continuity member is freely movable relative to the coupling member and the connector body.

19. The method of claim 16, wherein the continuity member is a closed revolute structure.

20. The method of claim 16, wherein the continuity member is continuity member is not a closed revolute structure.

21. A coaxial cable connector comprising:

a connector body having a first body end configured to face away from an interface port when the connector is in an assembled state, and a second body end configured to face toward the interface port when the connector is in the assembled state, the second body end including an inner body surface configured to engage a post when the connector is in the assembled state and an outer body surface facing away from the inner body surface;

a coupling element having a first coupling element end configured to engage the interface port when the connector is in the assembled state, and a second coupling element end configured to face away from the interface port when the connector is in the assembled state, the coupling element including:

an inner coupling element portion configured to rotatably engage an outer surface of the interface port when the connector is in the assembled state;

a radial mating edge end face surface extending along a radial direction from the inner coupling element portion and configured to face along a longitudinal direction of the connector and away from the interface port when the connector is in the assembled state; and an outer internal wall extending from the radial mating edge end face surface along the longitudinal direction of the connector and away from the interface port when the connector is in the assembled state; and a continuity element configured to be spaced away from the post and located outside the inner coupling element portion of the coupling element and outside the connector body proximate the second end of the connector body such that no portion of the continuity member is located either inside the connector body or inside the radial mating edge end face surface of the coupling element when the connector is in the assembled state, the continuity element including:

a coupling element side surface configured to face radially outward from a central axis of the coaxial cable connector when the connector is in the assembled state, maintain contact with only the outer internal wall of the coupling element when the connector is in the assembled state and when the connector body and coupling element move relative to each other; and a body engaging side surface configured to face radially inward from the central axis of the coaxial cable connector and contact only the outer body surface of the body when the connector is in the assembled state; and wherein the continuity element constantly biases the outer internal wall of the coupling element to establish and maintain continuous electrical continuity between the coupling element and the connector body when the connector is in the assembled state and when the coupling element rotates about a central axis of the coaxial cable connector.

* * * * *

UNITED STATES PATENT AND TRADEMARK OFFICE

CERTIFICATE OF CORRECTION

PATENT NO. : 8,550,835 B2
APPLICATION NO. : 13/860964
DATED : October 8, 2013
INVENTOR(S) : Noah Montena It is certified that error appears in the above-identified patent and that said Letters Patent is hereby corrected as shown below:

In the Claims

Correction of Claim 1, is as follows:

Column 17, line 39, please change “member” to --element--;
line 54, please change “portion” to --port--.

Correction of Claim 7, is as follows:

Column 18, line 16, change “the” to --an--.

Correction of Claim 8, is as follows:

Column 18, line 56, change “element” to --member--;
line 59, change “element” to --member--;
line 60, change “element” to --member--.

Correction of Claim 10, is as follows:

Column 19, line 3, change “connector body” to --body member--.

Correction of Claim 14, is as follows:

Column 19, line 11, delete “continuity member is”.

Correction of Claim 16, is as follows:

Column 19, line 50, change “connector body” to --body member--.

Correction of Claim 18, is as follows:

Column 19, line 61, change “connector body” to --body member--.

Signed and Sealed this
Eighteenth Day of November, 2014

Michelle K. Lee

Michelle K. Lee
*Deputy Director of the United States Patent and Trademark Office*

Correction of Claim 20, is as follows:

Column 20, line 2, delete “continuity member is”.

Correction of Claim 21, is as follows:

Column 20, line 34, change “member” to --element--.